US012523110B2

(12) United States Patent
Riley et al.

(10) Patent No.: US 12,523,110 B2
(45) Date of Patent: Jan. 13, 2026

(54) LIGHTWEIGHT FLOW MODULE

(71) Applicant: FMC Technologies, Inc., Houston, TX (US)

(72) Inventors: Paul L. Riley, Houston, TX (US); Ramu Valliappan Manickam, Singapore (SG); Wei Soung Tan, Singapore (SG); May-Ling Rachel Ho, Singapore (SG); Guoxiang Calvin Wu, Singapore (SG)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 18/937,871

(22) Filed: Nov. 5, 2024

(65) Prior Publication Data

US 2025/0092752 A1 Mar. 20, 2025

Related U.S. Application Data

(60) Division of application No. 18/328,134, filed on Jun. 2, 2023, now Pat. No. 12,168,908, which is a continuation of application No. 17/201,807, filed on Mar. 15, 2021, now Pat. No. 11,702,899, which is a continuation of application No. 16/305,723, filed on Nov. 29, 2018, now Pat. No. 10,947,803, which is a continuation-in-part of application No. PCT/US2016/057484, filed on Oct. 18, 2016, which is a continuation-in-part of application No. PCT/US2016/034976, filed on May 31, 2016.

(51) Int. Cl.

| | |
|---|---|
| ***E21B 33/035*** | (2006.01) |
| ***E21B 33/043*** | (2006.01) |
| ***E21B 33/064*** | (2006.01) |
| ***E21B 33/076*** | (2006.01) |
| ***E21B 34/02*** | (2006.01) |
| ***E21B 34/04*** | (2006.01) |
| ***E21B 43/013*** | (2006.01) |

(52) U.S. Cl.

CPC ..... *E21B 33/0355* (2013.01); *E21B 33/035* (2013.01); *E21B 34/025* (2020.05); *E21B 34/04* (2013.01); *E21B 33/043* (2013.01); *E21B 33/064* (2013.01); *E21B 33/076* (2013.01); *E21B 43/013* (2013.01); *E21B 2200/01* (2020.05)

(58) Field of Classification Search

CPC .. E21B 33/0355; E21B 33/035; E21B 34/025; E21B 34/04; E21B 33/043; E21B 33/064; E21B 33/076; E21B 43/013; E21B 2200/01

See application file for complete search history.

(56) References Cited

U.S. PATENT DOCUMENTS

| | | | | |
|---|---|---|---|---|
| 9,428,981 | B2 * | 8/2016 | Hosie | E21B 17/01 |
| 2016/0160605 | A1 * | 6/2016 | Ross | E21B 34/04 166/368 |

* cited by examiner

*Primary Examiner* — James G Sayre
(74) *Attorney, Agent, or Firm* — Osha Bergman Watanabe & Burton LLP

(57) ABSTRACT

A flow control module includes an inlet hub coupled to a first flow passage having a first flow bore, a flow meter associated with the first flow bore and positioned for top-down fluid flow, a choke disposed in a second flow passage having a second flow bore, the second flow passage coupled to a distal end of the first flow passage, and an outlet hub coupled to a distal end of the second flow passage, the outlet hub facing in a different direction from the inlet hub.

9 Claims, 16 Drawing Sheets

--PRIOR ART--

LIGHTWEIGHT FLOW MODULE

CROSS-REFERENCE TO RELATED APPLICATIONS

This application is a divisional application of U.S. application Ser. No. 18/328,134, filed on Jun. 2, 2023, which is a continuation application of U.S. application Ser. No. 17/201,807, filed on Mar. 15, 2021, which is a continuation application of U.S. application Ser. No. 16/305,723, filed on Nov. 29, 2018, which is a National Stage Entry of International Application No. PCT/US2016/057484, filed Oct. 18, 2016. International Application No. PCT/US2016/057484 is a continuation-in-part application of International Application No. PCT/US2016/034976, filed May 31, 2016. Each of these applications is incorporated herein by reference in its entirety.

BACKGROUND

Flow control modules may be useful in the process of extracting and managing wells that are drilled into the earth to retrieve one or more subterranean natural resources, including oil and gas. Flow control modules may be utilized both offshore and onshore. In offshore environments, flow control modules are particularly useful in directing and managing the flow of fluids (e.g. oil and/or gas) from one or more subsea wells, including satellite wells. A flow control module is a structure having a set of pipes and components through which fluid, such as oil and gas, may flow. Further, flow control modules may include a number of flow control devices, including chokes, and may also include a number of instruments or devices for measuring and obtaining pertinent data about the fluid flowing through the one or more pipes located in the flow control modules.

When used in a marine environment, a subsea flow control module may be landed and locked adjacent to a subsea tree or other subsea structures. As part of field architecture and planning, the location of subsea trees around one or more wells involves the planning for flow control modules that assist in routing the fluids produced from the wells to another subsea structure or to a riser pipeline for further processing.

Flow lines are often used to interconnect a flow control module to another subsea structure as part of a subsea oil and gas field layout for fluid communication. Such flow lines may generally be rigid or flexible hoses or pipes that are provided with subsea mateable connectors at either end. Such flexible hoses or pipes are known in the art as jumpers or spools, and may be used to connect several wells and other subsea equipment together.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to an assembly that includes a flow control module having an inlet hub coupled to a first flow passage having a first flow bore, a flow meter associated with the first flow bore and positioned for top-down fluid flow, a choke disposed in a second flow passage having a second flow bore, the second flow passage coupled to a distal end of the first flow passage, and an outlet hub coupled to a distal end of the second flow passage, the outlet hub facing in a different direction from the inlet hub.

In another aspect, embodiments of the present disclosure relate to a method for using a flow control module that includes connecting an inlet hub of the flow control module to a flow passage of a subsea tree, connecting an outlet hub of the flow control module to a flowline directed away from the subsea tree, directing fluid from the flow passage of the subsea tree through the inlet hub of the flow control module, directing the fluid through at least one flow passage located in the flow control module to the outlet hub, and directing the fluid from the outlet hub to the connected flowline.

In yet another aspect, embodiments of the present disclosure relate to a system that includes a first flow control module having an inlet and at least one outlet, a main line that is in fluid communication with the inlet, and a first branch line coupled to the main line and to a first outlet of the at least one outlet, a first equipment device connected to the inlet, and a second equipment device connected to the first outlet.

Other aspects and advantages of the invention will be apparent from the following description and the appended claims.

DETAILED DESCRIPTION

Figure 1:
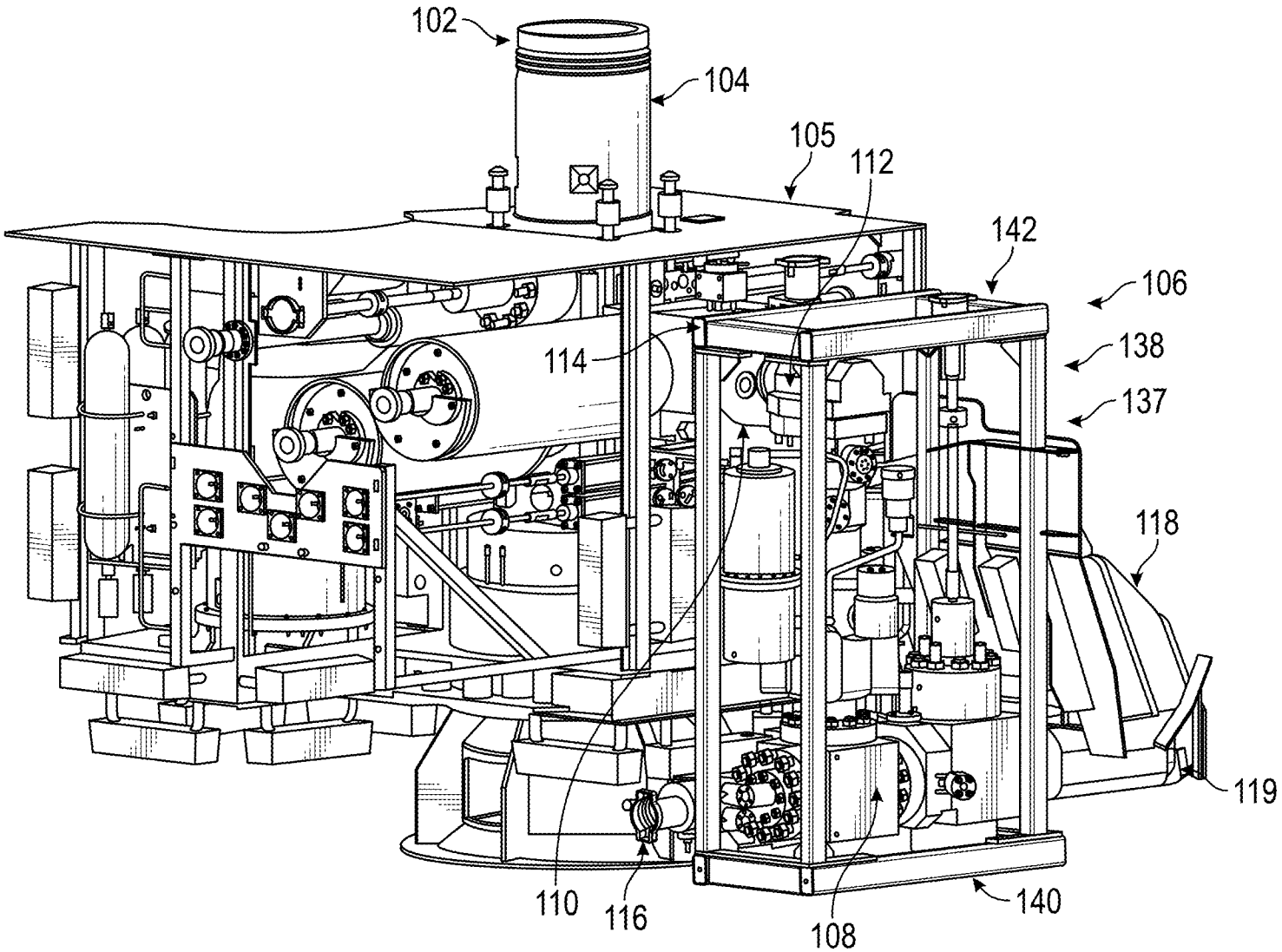
FIG. 1 is a perspective view of a flow control module assembly coupled to a subsea tree in accordance with one or more embodiments of the present disclosure.

In one aspect, embodiments disclosed herein relate to a tree assembly including a flow control module connected to a tree, where an outlet of the tree assembly is provided at the flow control module. By providing the outlet of a tree assembly on the flow control module portion of the tree assembly, embodiments of the present disclosure may have a jumper connected directly to the outlet provided at the flow control module. Further, a more compact and reduced flow path arrangement through a tree assembly (e.g., a reduced number of turns in the flow path through the flow control module) may be achieved from designing a configuration of the tree assembly that provides an outlet at the flow control module portion of the tree assembly. As used herein, a "tree assembly" may include a tree disposed around a core assembly and a flow control module attached to the tree. Tree assemblies according to embodiments of the present disclosure may include a tree, a flow control module and/or a core assembly designed to have a more compact configuration and/or reduced weight when compared to conventional tree assemblies.

In another aspect, embodiments disclosed herein relate to flow control modules. A flow control module may also be interchangeably referred to as a flow control module assembly in the present disclosure. As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

Flow control modules are apparatuses that include multiple pipes and components that are arranged in a certain layout and contained within a frame or frame housing. The pipes or conduits included in flow control modules may be used to direct fluid produced from or injected into a subsea well. As used herein, fluids may refer to liquids, gases, and/or mixtures thereof. In addition, one or more chokes may be disposed in one of the pipes or passageways of a flow control module. As known in the art, a choke may be an apparatus used to control pressure of fluid flowing through the choke and also may control a back pressure of a corresponding downhole well. Other instruments and devices, including without limitation, flow meters, sensors, and various valves may be incorporated within a flow control module.

Conventional flow control modules in the oil and gas industry are typically very large and heavy. Conventional flow control modules may include an extensive layout and arrangement of pipes that weigh several tons each. In some instances, a pipe used to direct fluid into another pipe may be ten inches in diameter and may include complicated bends or changes in orientation. Such flow control modules may be both heavier in weight and may also be more expensive to manufacture because of the higher number of parts and components. For example, in order to connect conventional flow control modules to a flowline, such as a well jumper (i.e., a pipe with a connector on each end) additional pipe work is required to be connected from conventional flow control modules to the well jumper. This additional pipework needed to connect a flow control module to a well jumper adds to the weight, installation costs, and overall cost of flow control systems such as a flow control module.

In addition to the above, conventional flow control modules typically include one or more flow meters that measure various properties or conditions of a fluid. Conventional flow control modules include one or more flow meters oriented for "bottom-up" flow of fluid, which usually requires adding intermediate pipework that further adds to the weight and cost of assembling such a flow control module.

Subsea flowlines are often used for the transportation of crude oil and gas from other subsea structures. Examples of subsea structures that may be interconnected or connected to one of the flowlines mentioned above include without limitation subsea wells, manifolds, sleds, Christmas trees or subsea trees, as well as Pipe Line End Terminations (PLETs), and/or Pipe Line End Manifolds (PLEMs). Examples of subsea flowlines include without limitation jumpers and spools. Further, subsea flow lines may include flexible or rigid flowlines, including rigid jumpers, rigid flowlines with flexible tails and flowline risers. Achieving a successful tie-in and connection of subsea flowlines is an important part of a subsea field development. Additional challenges further exist in a subsea environment for connection from one structure to another while both minimizing costs and providing flexibility for future changes to the overall layout of a field or well.

Accordingly, one or more embodiments in the present disclosure may be used to overcome such challenges as well as provide additional advantages over conventional flow control modules as will be apparent to one of ordinary skill. In one or more embodiments, a flow control module assembly may be lighter in weight and lower in cost as compared with conventional flow control modules due, in part, to an incorporation of a flow meter capable of operating with top-down fluid flow and to a reduced number of parts and pipes necessary for a flow control module having a top-down fluid flow. Further, according to embodiments of the present disclosure, a flow control module may be directly connected to a flowline such as a well jumper or similar flowline instead of requiring additional pipework to connect the flow control module to the flow line, thus reducing cost and weight of such a flow control module.

Flow control modules of the present disclosure may have a reduced number of components and/or a reduced flow path length, giving the flow control module a compact configuration. A compact flow control module may be used in combination with a tree having a compact configuration, as described below (e.g., a compact tree having a compact core assembly, a compact tree having an integrally formed single central valve block, and/or a compact tree having a reduced number of components and/or flow path length).

Flow control modules according to embodiments of the present disclosure may include an outlet configured to direct fluid in a direction away from the direction in which the inlet of the flow control module is configured. In some embodiments, where an inlet of a flow control module is connected to a tree, an outlet of the flow control module may be configured to direct fluid in a direction away from the tree. In some embodiments, a jumper or other equipment flowline may be connected to an outlet of a flow control module configured to direct fluid away from a tree connected to the flow control module and to another equipment unit.

Further, in one or more embodiments, a flow control module assembly may include more than one outlet, including two or three outlets. In addition, a flow control module assembly may be arranged in series to distribute and manage fluid flow over a wider area in some instances and to connect to multiple subsea equipment. For example, a first control module may have an inlet connected to a subsea tree and an outlet configured to direct fluid away from the tree, where the outlet may be connected to an inlet of a second control module.

Turning to FIG. 1, FIG. 1 shows a perspective view of a flow control module assembly coupled to a subsea tree in accordance with one or more embodiments of the present disclosure. In one or more embodiments, subsea tree 104 may be coupled to a downhole well or a well head. As known in the art, a subsea tree, such as subsea tree 104 may be a structure useful for producing fluid or injecting fluid into a downhole well, and is often a complex configuration of actuated valves and other components having various functions relevant to the downhole well. It is noted that subsea tree 104 in one or more embodiments may be configured as a horizontal or vertical subsea tree. Subsea tree 104 may include subsea tree frame 105, which surrounds or encases the vertical body of subsea tree 104. Subsea tree 104 is a separate subsea structure from flow control module 106. As known to those of ordinary skill in the art, a blowout preventer (BOP) (not shown) may be coupled to a top hub 102 of subsea tree 104.

Figure 3:
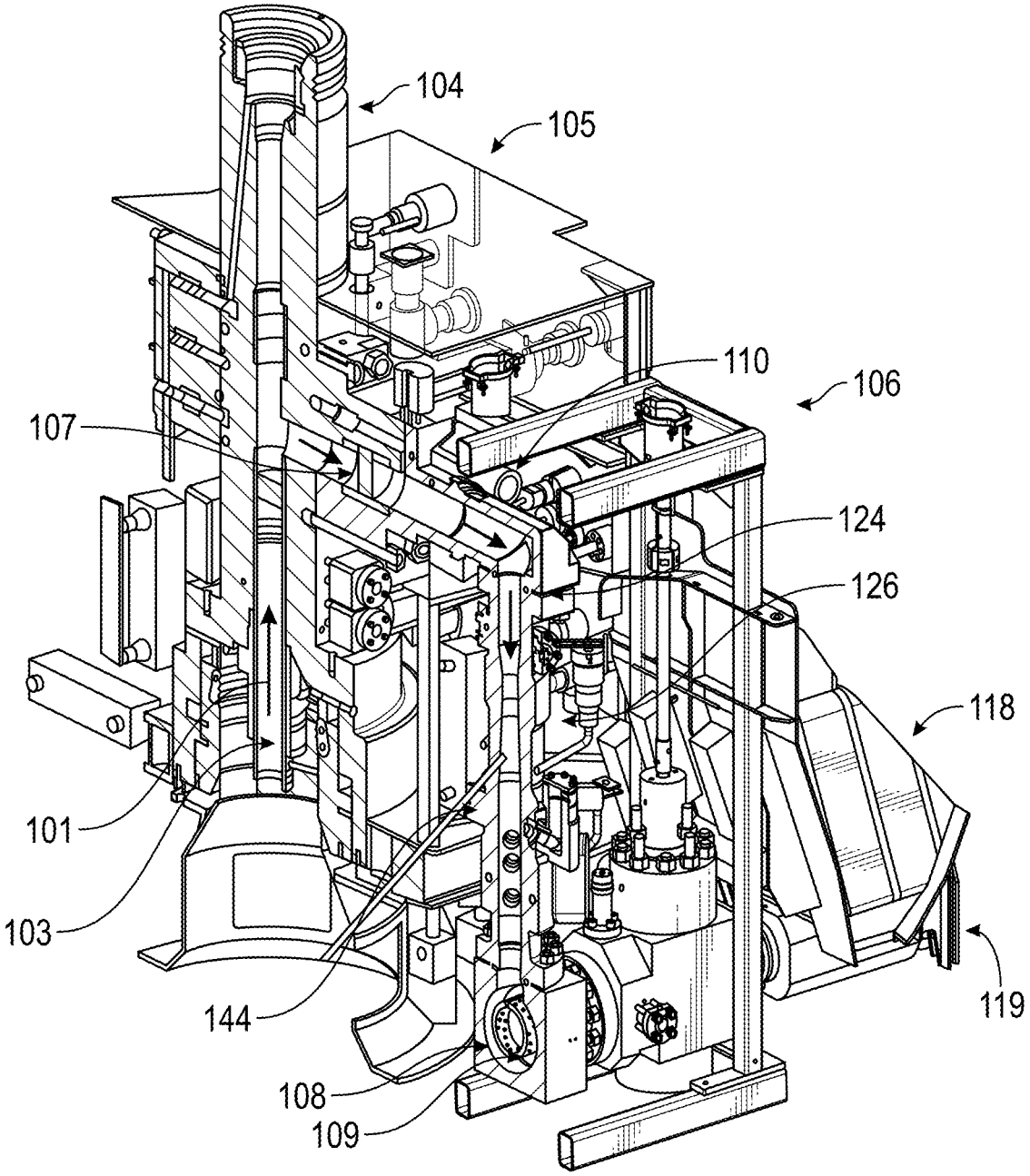
FIG. 3 is a cross-sectional view of the flow control module assembly of FIG. 2 in accordance with one or more embodiments of the present disclosure.

In one or more embodiments, subsea tree 104 may include a production wing block 114 or a wing valve may be incorporated into the main body of the tree. Fluids from subsea tree 104 may flow to production wing block 114, including in some embodiments, flowing up a vertical borehole (e.g. vertical flow bore 103 in FIG. 3) of subsea tree 104. Further, production wing block 114 may include a production wing valve 107 as shown in FIG. 3. A wing valve is a valve that may be selectively closed or opened to control the flow of fluid from a body of subsea tree 104 and through a flow passage of production wing block 114.

In one or more embodiments, flow control module 106 may be used to direct fluid flowing from subsea tree 104 to another subsea structure or distribution point for storage and/or processing.

A subsea structure may refer without limitation to a subsea tree, a manifold, a PLEM, or a PLET. A manifold (not shown) is a subsea structure, as known in the art, may be an arrangement of piping or valves designed to collect the flow from multiple wells into a single location for export and to provide control, distribution and monitoring of the fluid flow. In other embodiments, the fluid flowing from flow control module 106 may be directed to a PLEM or a PLET.

In one or more embodiments, subsea tree 104 is connected to flow control module 106. In one or more embodiments, connector 110, as shown in FIG. 1, is used to connect production wing block 114 or the tree main body with flow control module 106. Connector 110 may be any type of connector known in the art, including without limitation a collet connector, a clamp connector, or a flanged connector.

Connector 110 may be any type of connector known in the art and may be oriented horizontally, vertically, or at any angle in between. In one or more embodiments, connector 110 is a horizontal connector that connects with inlet 112 of flow control module 106, whereby inlet 112 is oriented for a horizontal connection, such as a collet connector, a clamp connector, or flanged connector. By connecting the flow control module 106 directly to the production wing block 114, an intermediate flow loop (including welded pipe, flanges, and elbows) is not needed. According to embodiments of the present disclosure, a horizontal connection (or in some instances an angled connection) to a production wing block located on subsea tree 104 and to a well jumper (not shown) may naturally protect critical sealing surfaces of those connections from dropped object impact. The flow control module 106 may be coupled to the tree frame 105 and supported by the production win block 114. In other embodiments, the flow control module 106 may be supported by another structure mounted to a conductor housing.

In one or more embodiments, an adaptor spool or flow loop (not shown) may be used between production wing block 114 and a connector used to connect flow control module 106 to tree frame 105 (e.g. via connector 110). In some embodiments, the connector is coupled (for example, by bolting or other mechanical means) on to the production wing block 114 instead of being an integral component.

Figure 4:
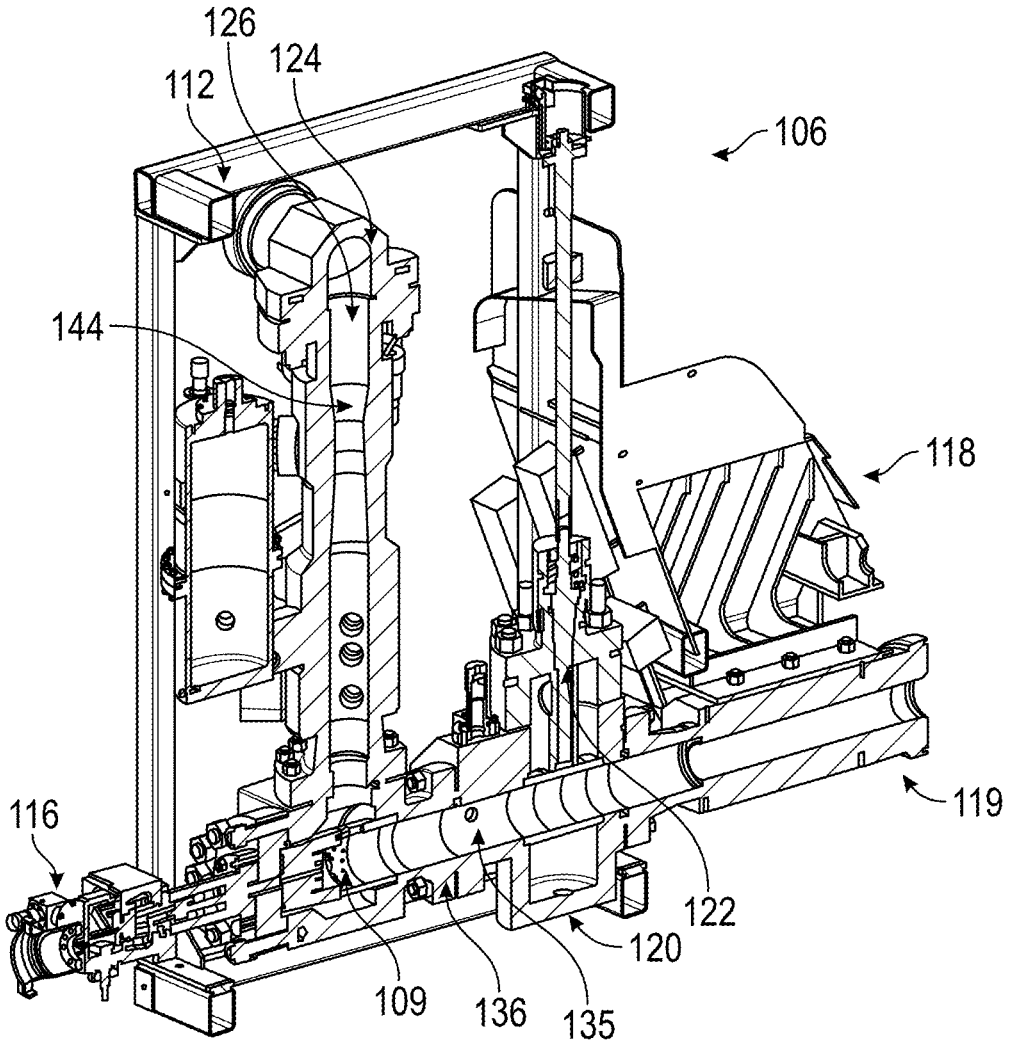
FIG. 4 is a cross-sectional view of the flow control module assembly coupled to a subsea tree of FIG. 1 in accordance with one or more embodiments of the present disclosure.
Figure 7:
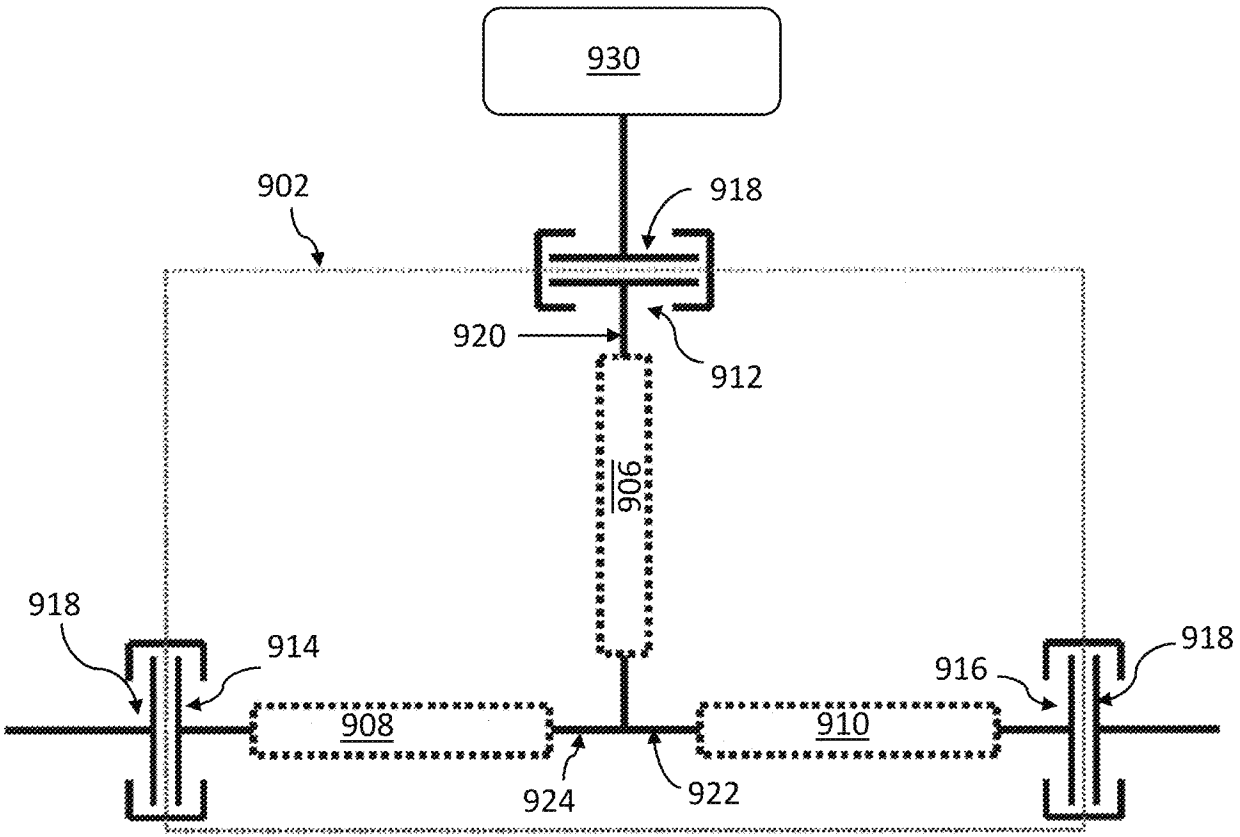
FIG. 7 shows a schematic view of a flow control module assembly having at least two outlets in accordance with one or more embodiments of the present disclosure.
Figure 8:
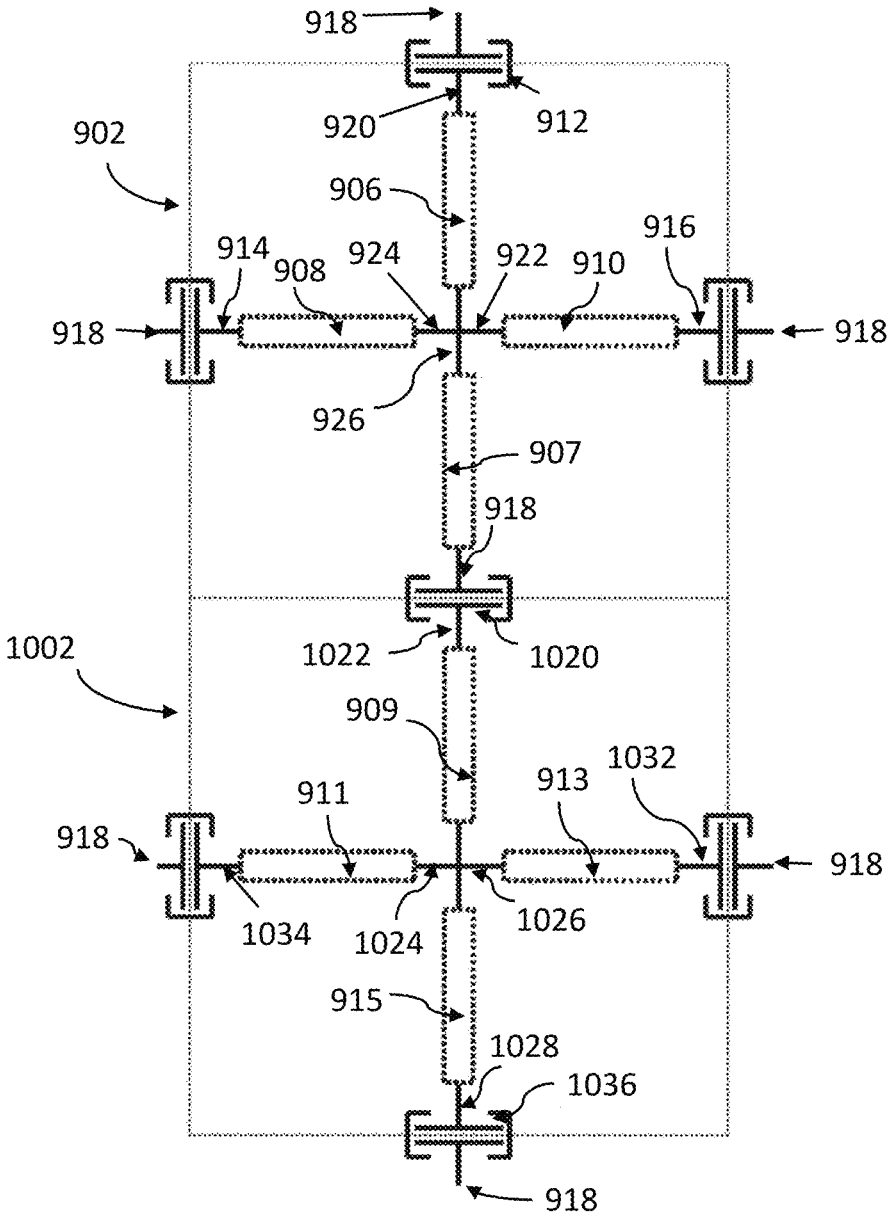
FIG. 8 shows a schematic view of two flow control module assemblies coupled in series having at least three outlets for each flow control module assembly in accordance with one or more embodiments of the present disclosure.

According to embodiments of the present disclosure, flow control module 106 includes inlet 112, outlet 119, flow passage 124 and flow passage 136 (as shown in FIG. 4). One of ordinary skill in the art will appreciate that these elements are not limited to any specific orientation. Inlet 112 provides an entrance into flow control module 106 and outlet 119 provides an exit out of flow control module 106. According to one or more embodiments, fluid flowing from subsea tree 104 may flow into inlet hub 112 of flow control module 106 and be directed out of flow control module 106 through an outlet hub of flow control module (e.g. outlet hub 119). As shown in FIGS. 1-5, the outlet hub 119 may be a single outlet; in other embodiments, as shown in FIGS. 7 and 8, the outlet hub may include multiple outlets. Furthermore, each outlet may include one or more bores for flowing hydrocarbons or injection fluids.

In one or more embodiments, flow control module 106 may include a direct connection to production wing block 114 of subsea tree 104.

As shown in FIG. 1, flow control module 106 may include frame 138 made up of a plurality of frame support members. Frame 138 generally contains the components and pipework of flow control module 106. In one or more embodiments, flow control module 106 is retrievable such that frame 138 and the entirety of the components located within flow control module 106 may be retrieved to the surface for maintenance or replacement. Accordingly, frame 138 may include a top end 142 and a bottom end or base 140. Further, side support members 137 may be connected to top end 142 and base 140 to form frame 138. Various fasteners and attaching mechanisms as known in the art may be used to connect the frame support members together including without limitation brackets, bolts, screws, etc. In other embodiments, frame 138 may be integrally formed of any type of material, including metals, composites, etc.

The components of the flow control module 106, including inlet 112, outlet 119, vertical flow passage 124, and horizontal flow passage 136 may be attached to one or more frame support members of frame 138 using various methods as known in the art, including without limitation mechanical fasteners, welding, integrally forming, adhesives, etc.

In one or more embodiments, flow control module 106 may further include a choke block 108. Choke block 108 may include a choke (e.g., choke 109 as shown in FIG. 3)

which may control pressure by controlling the size of an opening located in the choke through which a fluid passes. In one or more embodiments, choke 109 disposed in choke block 108 may be included in a flow passage of flow control module 106. In accordance with one embodiment, choke 109 may be located in a horizontal flow passage 136 as shown in FIG. 4.

Choke 109 may include a choke body that may be permanently or removably fixed to choke block 108. One or more seals and retention mechanisms (such as a clamp or crown or bonnet) may be used to hold choke 109 in place. Further, one or more actuators, such as choke actuator 116 may be used to actuate or operate choke 109. As illustrated in FIG. 1, choke actuator 116 may be disposed on one side of choke block 108 and may include one or more actuating mechanisms. Further, as shown in FIG. 3, choke 109 may be included in a horizontal flow passage 136 of flow control module 106. According to one or more embodiments, choke 109 may be disposed beneath a lower end of vertical flow passage 124.

In one or more embodiments, choke 109 may be either a fixed choke or adjustable choke. A fixed (also known as positive) choke conventionally has a fixed aperture (orifice) used to control the rate of flow of fluids. An adjustable (or variable) choke has a variable aperture (orifice) installed to restrict the flow and control the rate of production from the well. Choke 109 may be a variable choke, such that the choke may include a mechanism that allows changing the size of the opening to control both the flow rate of the fluid passing through choke 109 and a pressure associated with the fluid. Choke 109 may operate such that the larger the opening through the choke, the higher the flow rate. A larger opening in the choke creates a smaller pressure drop across the choke, and hence, a higher flowrate. Likewise, a smaller opening in the choke results in a higher pressure drop and a lower flow rate. In one or more embodiments, choke 109 may be an adjustable choke, a fixed or positive type choke, or any other type of choke known in the art.

Those of ordinary skill in the art will appreciate that choke 109 may be actuated via choke actuator 116 and one or more mechanisms through different methods including electric and hydraulic actuators. For example, choke 109 disposed in choke block 108 may be mechanically adjusted by a diver or a remotely operated vehicle (ROV), or may be adjusted remotely from a surface control console.

In accordance with one or more embodiments, choke 109 may incorporate any choke trim suitable for the optimal performance and control of the fluid expected to flow into and out of choke 109. Choke trim as understood in the art may be a pressure-controlling component of a choke and controls the flow of fluids. Choke trim design types include, without limitation, needle and seat, multiple orifice, fixed bean, plug and cage, and external sleeve trims. Sizing of the choke 109 may also depend on a myriad of factors unique to the type of fluid flowing through choke 109. Thus, choke block 108 may include any type of choke as understood in the art and be of any size useful for the specific flow parameters of the subsea tree 104.

In accordance with one or more embodiments, flow control module 106 may include a connector such as a flowline jumper connector (not shown). The flowline connector may facilitate a direct connection to an outlet hub 119 of flow control module 106. For example, a flowline, such as a jumper, jumper spool, or umbilical, may be directly connected to flow control module 106 at outlet hub 119. Thus, the connector connects to one end of a jumper, jumper spool, or umbilical, and the other end of the jumper, jumper spool, or umbilical may connect to another subsea structure, such as a manifold, a subsea tree, PLET, PLEM, in-line tees, riser bases, etc. In one or more embodiments, the connection may include, for example, a collet- or clamp-based connector. In certain embodiments, the connection may be part of an ROV-operated connection system that may be used for the horizontal or vertical connection of rigid or flexible flowlines, such as without limitation jumpers, spools, and umbilicals towards other subsea structures, such as manifolds, subsea trees, PLETs, PLEMs, in-line tees, riser bases, etc. Having a horizontal connection may advantageously allow flow control module 106 to not "hinge over" to connect to a flow line. In accordance with embodiments disclosed herein, the flow control module is run with the flowline jumper and is rotated approximately 90 degrees to allow the connection to the tree to be made up.

It is noted that the ability to directly connect from outlet hub 119 to a flowline, such as a jumper, spool, or umbilical, without inclusion of or with a reduced number of additional pipes and adaptors, may enable flow control module 106 to be lighter in weight. Specifically, a flowline jumper connector connects directly to the outlet hub 119 so that the flowpath of fluid exiting the flow control module does not reenter the tree assembly. Further, flow control module 106 may reduce the manufacturing and installation costs for flow control module 106.

Figure 2:
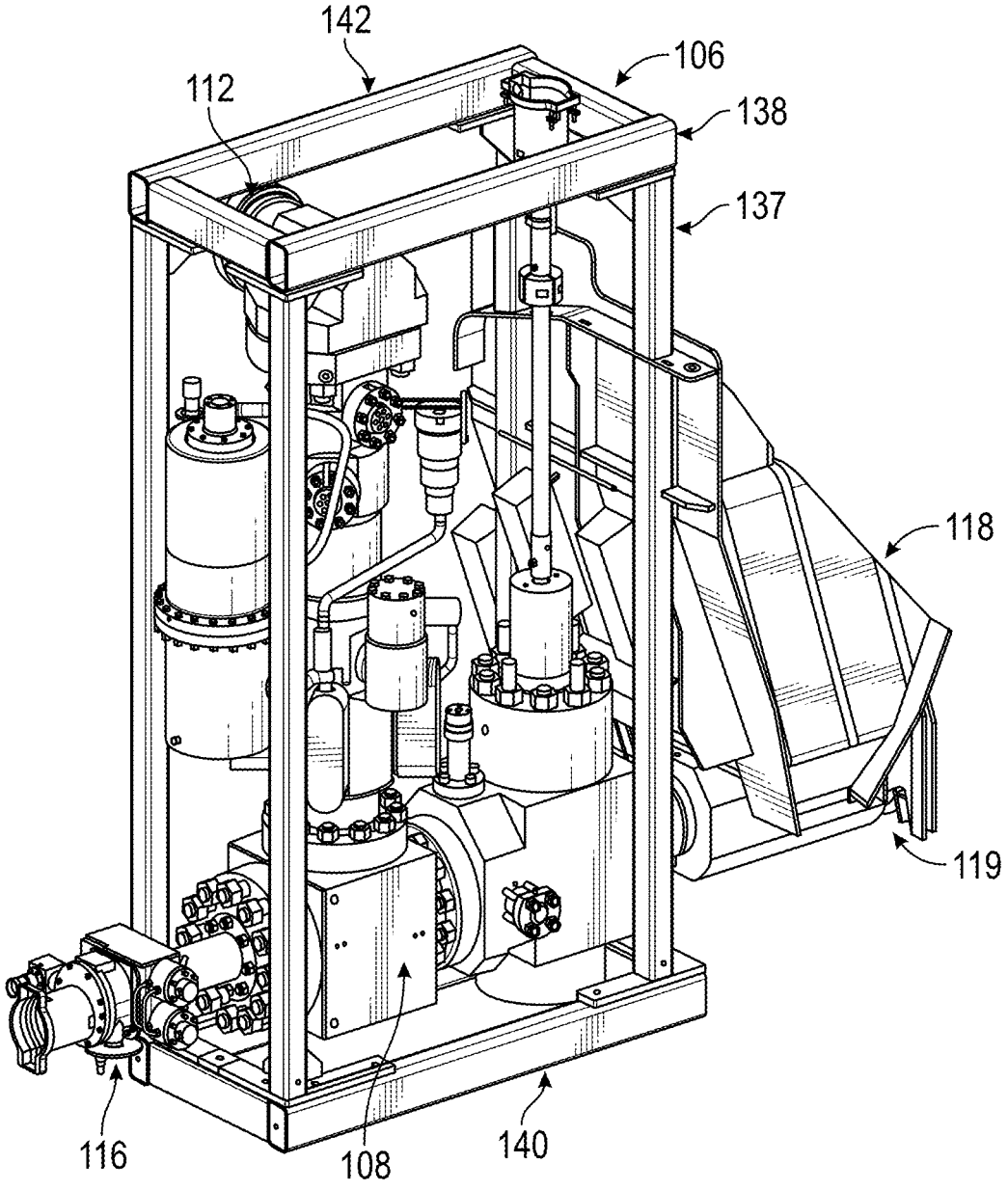
FIG. 2 is a perspective frontal view of a flow control module assembly in accordance with one or more embodiments of the present disclosure.

Turning to FIG. 2, FIG. 2 shows a perspective view of flow control module 106. Flow control module 106 in FIG. 2, includes the same elements as discussed above with respect to FIG. 1. In particular, flow control module 106 in FIG. 2 may include a frame 138 having a top end 142, a bottom end or base 140, and one or more side support members 137 that further form frame 138. Frame 138 may act as the housing that supports and/or encases one or more components of flow control module 106, including choke block 108 and choke actuator 116. Further, FIG. 2 shows inlet 112 of flow control module 106 and outlet hub 119.

FIG. 3 shows a cross sectional view of the flow control module assembly of FIG. 2 in accordance with one or more embodiments of the present disclosure. As shown, flow control module 106 includes vertical flow passage 124 having vertical flow bore 126. Fluid flowing from inlet hub 112 (from, e.g., subsea tree 104) may flow through the conduit connected to inlet hub 112 and down through vertical flow bore 126.

In one or more embodiments, a flow meter 144 may be positioned within vertical flow bore 126. A flow meter as known by those in the art may be used to measure one or more properties or condition of flow of a fluid. In one or more embodiments, flow meter 144 may be a multi-phase flow meter. In other embodiments, flow meter 144 may be a wet gas flow meter or a single phase flow meter. In other embodiments, flow meter 144 may be removed (i.e., the vertical flow bore 126 may not include a flow meter) and/or configured to include virtual metering, in which the flow is not measured directly but is determined, calculated, or otherwise extrapolated from indirect measurements such as pressure and temperature measurements. In such embodiments, the flow control module may be said to include a "virtual meter."

In accordance with embodiments of the present disclosure, flow meter 144 may be "inverted" (as compared to conventional flow meters) and configured for a top-down flow regime (as shown in FIG. 4), whereby fluid flows down through vertical flow bore 126 and through flow meter 136. Such an orientation reduces or eliminates settling of the liquid phase of the fluid which may interfere with sensor measurements if the meter is horizontally oriented and allows a reduction in size and weight of the equipment when compared to a conventionally oriented meter with a "bottom up" flow direction.

Further, flow control module 106 may include a number of additional instruments and devices useful in monitoring a fluid flowing through flow control module 106. Such instruments and devices may include chemical meters, pressure and/or temperature sensors, erosion probes, densitometers, or other instruments/devices known in the art.

In one or more embodiments, a production isolation valve 120 (shown in FIG. 4) may be incorporated into the flow passage. An isolation valve as known to one of ordinary skill in the art may be used as a control valve in a fluid handling system that stops the flow of fluid to a given location, usually for maintenance or safety purposes. An isolation valve may further be used to provide flow logic (selecting one flow path versus another), and to connect external equipment to a system. A passageway 122 may be aligned with production isolation valve 120 to direct fluid through passageway 122 as needed, for example, for maintenance or safety purposes.

FIG. 3 illustrates a cross-sectional view of the flow control module assembly coupled to a subsea tree of FIG. 1 in accordance with one or more embodiments of the present disclosure. As shown in FIG. 3 subsea tree 104 may be coupled to flow control module 106. Arrows 101 in FIG. 3 show a flow path for fluids flowing from a reservoir and well bore (not shown) located beneath subsea tree 104. Accordingly, in one or more embodiments, subsea tree 104 may be adapted for use as a production subsea tree. However, it is noted, that subsea tree 104 may be configured for use with injection services and flow control module 106 may be adapted for use for injection services as well, which is further discussed below.

In accordance with one or more embodiments, fluids flowing up from a reservoir or well may flow upwardly through a vertical flow bore 103 of subsea tree 104 (as shown in FIG. 3). As known to those of ordinary skill in the art, subsea tree 104 may include one or more master valves (not shown) and/or swab valves (not shown) as well as additional components to regulate the flow of fluids through flow bore 103.

In accordance with one embodiment, FIG. 3 illustrates that a fluid may flow (along the flow path shown by arrows 101) through production wing valve 107 located in production wing block 114 (as shown in FIG. 1). Connector 110 connects production wing block 114 of subsea tree 106 to an inlet hub 112 (as shown in FIGS. 1 and 2) of flow control module 106. Fluid may proceed to flow through inlet hub 112 and to a vertical flow passage of flow control module 106, such as vertical flow passage 124, having a vertical flow bore 126. Fluid may flow through vertical flow passage 124. Fluid may then flow through choke 109, which is actuated by choke actuator 116, thereby regulating a pressure of the flowing fluid. The fluid from a reservoir or well (not shown) may proceed to flow through the horizontal flow bore 135 of horizontal flow passage 136 in flow control module 106. The fluid may proceed to flow to outlet hub 119 of flow control module 106 and to any connected subsea structure, including one or more flowlines.

Flow control module 106 thus provides a flow path for fluid to flow with a lighter weight and reduced number of bends and turns because of the top-down flow configuration. As discussed above, flow control module 106 may include a top-down flow meter (e.g. flow meter 144) which does not require additional piping for routing fluid to the top down flow meter 144. Further, flow control module 106 includes, in one or more embodiments, a horizontal connection between production subsea tree 104 and flow control module 106 as well as between outlet hub 119 and another subsea tree, which further reduces the weight and number of necessary pipes in the overall structure of flow control module 106. FIGS. 1-4 show a connector 118 (e.g., a universal horizontal connector, collet connectors, and clamp connectors) installed around outlet hub 119.

As noted above, subsea tree 104 may be used for fluid injection services into a downhole well or reservoir. Accordingly, a flow control module 106 may be configured for well injection services also. In such instances, choke block 108 may be located at an upper end of a vertical flow passage (e.g., vertical flow passage 124 in FIG. 4) located in the flow control module. In one or more embodiments, a flow meter may be positioned within vertical flow passage 124 and configured for a more traditional bottom-up flow regime.

Figure 5:
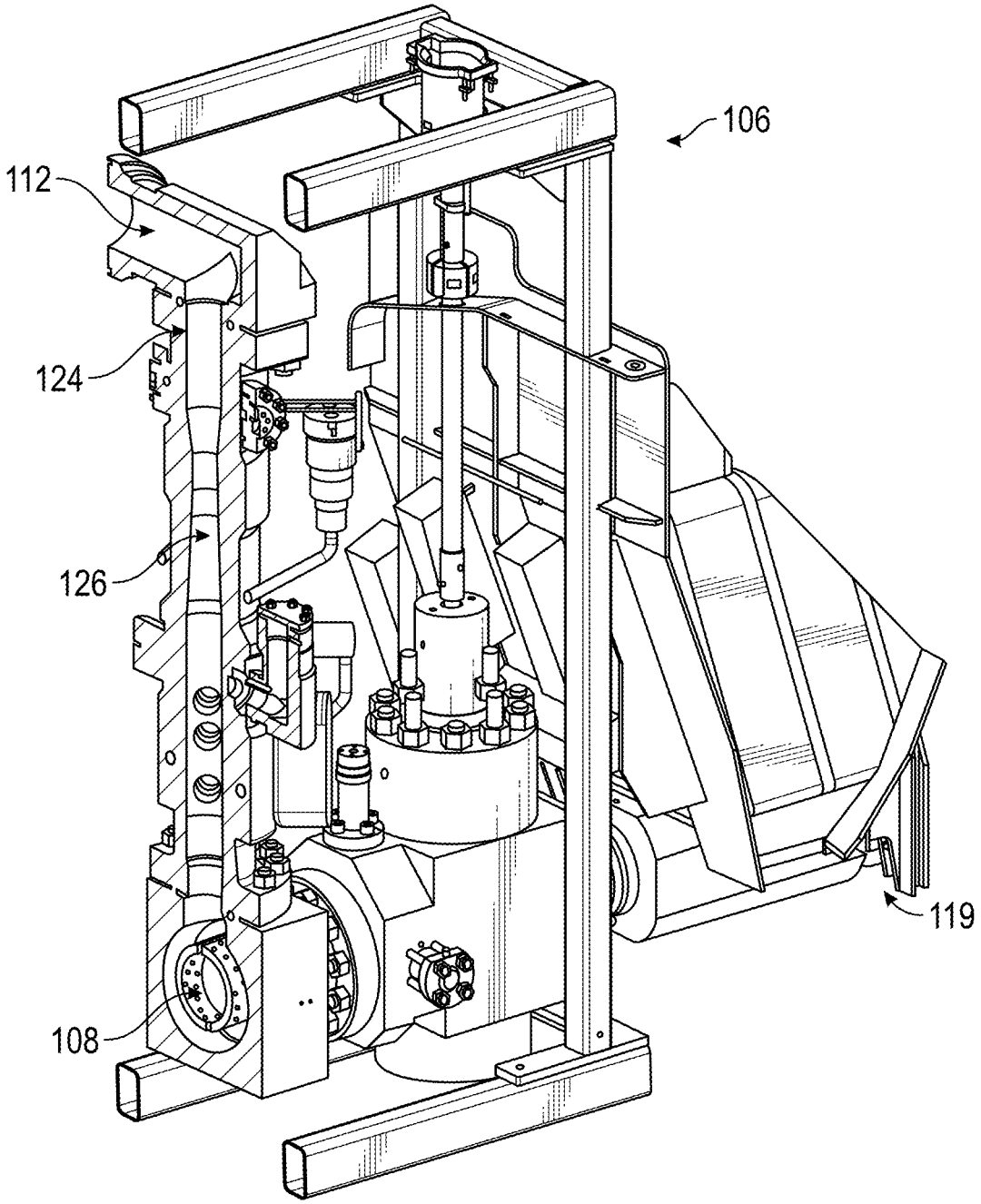
FIG. 5 is a partial sectional view of a vertical flow passage of the flow control module assembly of FIG. 2 in accordance with one or more embodiments of the present disclosure.

FIG. 5 illustrates a partial sectional view of vertical flow passage 124, including choke 109 disposed beneath a lower end of vertical flow passage 124.

In accordance with one or more embodiments, subsea tree 104, and flow control module 106 may be landed together or substantially simultaneously onto the subsea wellhead (not shown). In other embodiments, subsea tree 104 may be landed first and then flow control module 106 may be landed and coupled to subsea tree 104.

Advantageously, flow control module 106 may be separately landed independent from a flowline, such as a jumper, spool, or umbilical. Subsequently, according to one or more embodiments, a flow line, such as a jumper, spool, or umbilical, may be connected to outlet hub 119 of flow control module 106. Flow control module 106 may be retrievable to the surface in order to conduct repairs, inspection, or replacement of any components of flow control module 106 by disconnecting connector 110 located between tree frame 105 and flow control module 106.

Government regulations typically require at least two barriers (e.g., valves that may be selectively closed and regulated) be included in a subsea tree, such as subsea tree 104, to protect the environment, particularly the marine environment, from fluids flowing up through a subsea tree from a reservoir. In accordance with one or more embodiments, subsea tree 104 may include a number of valves, including a master valve and a production wing valve, such as wing valve 107 shown in FIG. 3, which may act as the necessary "barriers" required to protect the marine environment when flow control module 106 is removed.

According to one or more embodiments, subsea tree 104 may include passageways for hydraulic control fluid for a surface controlled subsurface safety valve (SCSSV) to isolate the wellbore fluids. Further, subsea tree 104 may include in one or more embodiments a production master valve (PMV) and a production wing valve (PWV) (e.g., 107 in FIG. 3). When these valves (SCSSV, PMV, and PWV) are closed, in one or more embodiments, flow control module 106 may be retrieved or removed from subsea tree 104. Access to a main bore (e.g., vertical bore 103) of subsea tree 104 may be provided after removal of the flow control module 106. The outlet on production wing block 114 may facilitate such main bore access of subsea tree 104 without requiring extensive well intervention. The main bore (e.g., vertical bore 103) and the valves of subsea tree 104 may be visually inspected and/or cleaned through the outlet provided in production wing block 114 once the flow control module 106 is removed via connector 110. For example, an ROV based borescope may be used to inspect a main bore and the valves located on subsea tree 104. Further, a washout tool or similar may be used to clean the main bore and the valves on subsea tree 104. Typical subsea flow control module/assemblies do not provide the ability to visually inspect or provide access to a main bore of a subsea tree or valves located a main bore of a subsea tree unless the entire subsea tree is retrieved to the surface and the tree is partially disassembled. In accordance with one or more embodiments disclosed herein, the flow control module 106 may be separately removed and access provided to a main bore of a subsea tree as well as to one or more valves without having to entirely retrieve the subsea tree to the surface.

In addition to the benefits described above, a lighter weight flow control module, such as flow control module 106 may further beneficially enable a lighter weight tree assembly that may reduce cost of the overall subsea tree system. A lighter weight of a tree and tree system may increase the range of vessels capable of installing a corresponding tree, thereby reducing the reliance on a limited number of multi service vessels (MSVs). It is noted that flow control module 106 may be used for onshore systems and surface trees as well.

Flow control modules may be used to direct flow away from one structure and sometimes may be used to connect to another subsea structure. Flow control modules according to embodiments of the present disclosure may include two connection points (e.g., a single inlet and a single outlet) to direct flow from one structure to another, or may include more than two connection points (e.g., a single inlet and multiple outlets) to direct flow selectively between more than two structures. For example, FIG. 6 shows a flow control module according to embodiments of the present disclosure having two connection points or tie-ins, and FIGS. 7 and 8 show flow control modules having more than two connection points or tie-ins.

Figure 6:
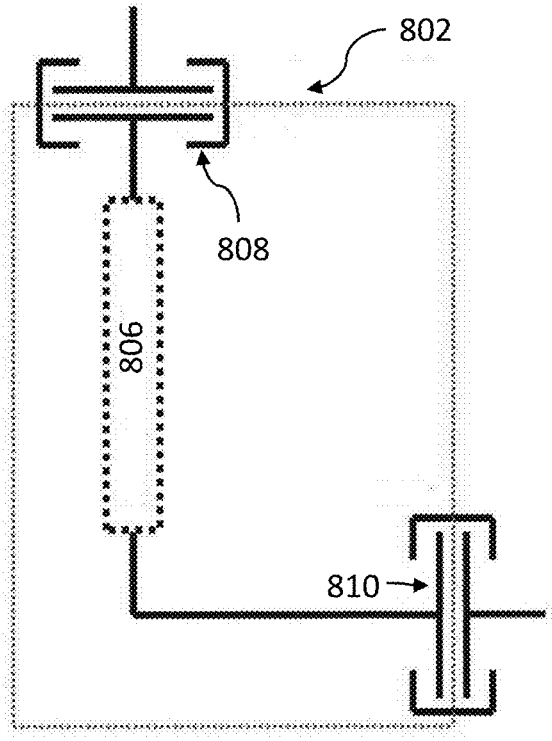
FIG. 6 shows a schematic view of a prior art flow control module assembly.

FIG. 6 shows flow control module 802, which includes a single inlet 808 and a single outlet 810, where the process instruments (choke valve, measurements, etc.) as previously described is identified as 806. Inlet 808 and outlet 810 may be provided each as a single bore (as shown), or as a dual bore configuration with both the single inlet and the single outlet contained within a single connector. The flow control module 802 may have the same or different types of connections on each of the inlet 808 and outlet 810 located at any angle, position and elevation to its mating equipment. For example, a connection may be a clamp, collet, diver flange or other connection type.

Flow control modules that accommodate multiple tie-ins or connections to additional subsea equipment devices through a plurality of outlet hubs (also known as outlets), such as the example flow control module 902 illustrated in FIG. 7, may be advantageous. As depicted, flow control module 902 may include an inlet 912 and at least two outlets, i.e., outlet 914 and 916. In other embodiments, flow control module 902 may include three outlets as shown in FIG. 8 and further discussed below. In other embodiments, flow control module 902, may include four, five, or six outlets or more as needed.

Referring to FIG. 7, flow control module 902 is a unit having multiple tie-in points or connections (i.e., tie-in connections 918) coupled to the outlets 914, 916 of the flow control module 902. Further, flow control module 902 is an apparatus that may be installed on another unit or base structure 930. Accordingly, in one or more embodiments, base structure 930 may be any type of subsea equipment, including a manifold, subsea tree, riser base, PLEMs, PLETs, or in-line tees. Base structure 930 may further include any well slot equipment such as a flowbase or tubing head, pipeline equipment, hydraulic distribution equipment, or similar. Flow control module 902 may be used for any type of service, including production and/or injection for any type of fluid.

According to embodiments of the present disclosure, flow control module 902 includes at least one main flow line (e.g., main line 920) and two additional branch flow lines (e.g., first branch line 922 and second branch line 924). Main line 920 as shown in FIG. 7 may be in fluid communication with one or more instruments or devices 906. Instruments or devices 906 may include flow control devices such as chokes. Further, instruments or devices 906 may include instruments such as flowmeters, pressure/temperature sensors, erosion/vibration monitors, injections points, sampling points, safety systems, processing/pumping equipment or similar.

In one or more embodiments, the first branch line 922 and/or the second branch line 924 may include the tie-in hubs or connectors 918 and specific isolation devices such as valves or other equipment depending on the system and field configuration. FIG. 7 shows instruments or devices 908 and 910, which may be instruments or devices suitable for the specific system within which flow control module 902 is located. In one or more embodiments, first branch line 922 and/or second branch line 924 may be located at any angle, position, or elevation relative to main line 920. Further, each of the lines (i.e., main line 920, first branch line 922, and second branch line 924) may have the same or different bore sizes relative to one another.

Flow control module 902 may be connected by a tie-in connection, e.g., tie-in connection 918 to subsea base structure 930. Tie-in connections 918 as shown in FIG. 7 may be provided at each outlet 912, 914, and 916 of flow control module 902. In other embodiments, tie-in connection 918 may be provided at only one or two of the outlets instead of all of the outlets 912, 914, and 916 on flow control module 902. In this embodiment, the outlet may be used for future expansion, such as daisy-chaining multiple wells together. The flow control module may include a blanking cap on the unused outlet that is removable to allow installation of a second jumper to connect the new well after it is completed.

Tie-in connections 918 may be configured as any kind of horizontal or vertical tie-in connection as known in the art. Further, tie-in connection 918 may be achieved using any tie-in systems suitable for the specific application to which flow control module 902 is configured. Further, tie-in connection 918 may be the same or different types of connections on each of the lines at the outlet points (e.g. 914 and 916). Tie-in connections 918 may be located at any angle, position, and elevation to connect with its mating equipment. In one or more embodiments, tie-in connection 918 may include any one of a clamp connector, collet connector, flange connector, or any type of connector.

In one or more embodiments, base structure 930 may be directly connected to flow control module 902 via a connector or may be connected using a flowline, such as, without limitation, a jumper, spool, or umbilical. Further, in one or more embodiments, flow control module 106 as described in FIGS. 1-5 may be connected to base structure 930. Further, in one or more embodiments, flow control module 106 (e.g., as shown in FIGS. 1-5) may be configured to include at least two or more outlets such as outlets 914 and 916 as shown in FIG. 7.

Tie-in connection 918 may be used to connect to any type of flowline, umbilical, or jumper spool using any tie-in tools known in the art. The present assignee has developed a series of Horizontal Tie-In systems which are designed to install and connect hydraulic and electrical umbilicals or jumpers between subsea modules and structures. Various configurations of jumpers and umbilicals may be used in conjunction with flow control module 902 to suit a variety of applications. The present assignee has further developed several Vertical Tie-In systems that may also be utilized to provide vertical connections for jumpers and umbilicals. These systems may include connectors that may be made up by hydraulic or non-hydraulic connectors.

In one embodiment, flow control module 902 may be connected to a manifold or similar type of subsea equipment. In such instances, in one or more embodiments, main line 920 may include instruments or devices 906 that are useful for a manifold header line. In addition, branch lines 922 and 924 may include instruments or devices 908 and 910 that are useful to a manifold branch line. In one or more embodiments, main line 920 is in fluid communication with branch line 922 and branch line 924. The various instruments or devices 906 located in main line 920 and instruments or devices 908 and 910 located in branch lines 922, 924 may control the flow of fluid. Accordingly, fluid may be configured to flow from main line 920 to branch line 922 and branch line 924 or vice versa. In other embodiments, fluid may be configured to flow to only branch line 922 or only branch line 924 depending on the type of flow control instruments and devices located in each line (e.g., main line or branch line) of flow control module 902. For example, in one or more embodiments, a choke may be included as a device in main line 920 and branch lines 922 and 924 in order to control fluid flow and/or direct fluid to a common export or outlet. According to embodiments of the present disclosure, lines (e.g., a main line and one or more branch lines) through a flow control module may have the same or different bore sizes relative to each other.

In one or more embodiments, flow control module 902 may be used to facilitate intervention operations. One type of well intervention operation that flow control module 902 may be used for is scale squeezing. Scale squeezing refers to one or more processes used to dissolve and remove unwanted scale build-up inside a production tubing in a subsea well in order to increase the oil recovery rate. This may be performed by injecting chemicals into the well using a chemical injection hose.

Another type of intervention operation that flow control module 902 may be used for is known as "pigging." Pigging refers to the process of using devices known as "pigs" to perform various maintenance operations on a pipeline. Pigging may be accomplished without stopping the flow of fluid in the pipeline. Pigging operations may include but are not limited to cleaning and inspecting the pipeline using a device that may be launched into a pipeline and received at a receiving trap located on the other end. Accordingly, in one or more embodiments, flow control module 902 may be used to perform intervention operations including without limitation scale squeezing, pigging, and hot oil circulation.

According to embodiments of the present disclosure, flow control module 902 may be useful for simplifying a field layout, minimizing a number of units installed subsea, as well as making the installed units more flexible and efficient for both current and future use. A single well development usually requires some sort of connection to additional independent equipment (e.g., manifolds, PLET, PLEM or similar) and it is desirable to provide options for any such future tie-in connections to enable field expansion at a later date. Intermediate flowlines such as jumpers that may be used to connect from a single well to such equipment will need tie-in points and access points, which flow control module 902 may provide.

Accordingly, in one or more embodiments, flow control module 902 may be connected to another subsea structure and any fluids that need to be injected into or produced from the subsea structure may be directed into or out one or more outlets (e.g. 914, and 916) of flow control module 902. Thus, flow control module 902 may provide numerous benefits and advantages due to its unique features. In another aspect, flow control module 902 may allow for "daisy chaining" another structure, such as a subsea tree within a field. Daisy chaining as referred to herein may describe the process of connecting several pieces of equipment or structures together, typically in series. Accordingly, flow control module 902 may provide tie-in connections for current and future use to another structure, such as a subsea tree or manifold, for well/flow line intervention or circulation of fluids.

In addition to the above, more than one flow control module may be connected to each other as part of a field layout. FIG. 8 shows an arrangement whereby more than one flow control module may be connected to each other. FIG. 8 illustrates flow control module 902 connected to flow control module 1002. In other embodiments, as many flow control modules may be connected to one another as needed to suit a specific application.

In one or more embodiments, flow control module 902 and flow control module 1002 include at least a single inlet hub and one outlet hub, although as noted previously, more outlet hubs may be included. In particular, flow control module 902 includes single inlet hub 912 and outlet hubs 914, 916 as shown in FIG. 7. Further, FIG. 8 illustrates that flow control module 902 includes a third outlet hub, i.e. outlet hub 918. Further, flow control module 1002 may include single inlet hub 1020 and outlet hubs 1032, 1034, and 1036.

In accordance with one or more embodiments, flow control module 106 as shown in FIGS. 1-5 may be utilized for flow control modules 902 and 1002 as shown in FIGS. 7 and 8. In such instances, flow control module 106 may be configured to include the specific number of outlets (e.g., two or three or more) to suit the specific application and installation requirements for each flow control module. Having a lighter weight flow control module 106 may contribute to lower costs of installation for a multi-well development of field 1114.

Flow control modules, such as flow control modules 902 and 1002 may offer a number of benefits over conventional systems. Flow control modules 902 and 1002 provide future tie-in points to add on or tie in to a manifold or similar structure without planning for such tie-ins early on during the initial field development. Having the future tie-in points on flow control modules 902 and 102 may allow for tie-ins to be added to the system at a later time without initial design consideration, and is a more cost-effective way to tie-into other subsea structures.

Further, as mentioned above, flow control modules according to the present disclosure may be lighter in weight compared with conventional systems, which may enable a light weight tree assembly that reduces costs of the tree system and also increases the ranges of vessels that can install the tree system, thereby reducing the reliance on certain types of subsea tree installation equipment. Flow control modules of the present disclosure may be relatively lighter, for example, by having a reduced number of turns in the flow path through the flow control module.

For example, according to embodiments of the present disclosure, a flow control module may include an inlet hub coupled to a first flow passage having a first flow bore, a second flow passage having a second flow bore, the second flow passage coupled to a distal end of the first flow passage, and an outlet hub coupled to a distal end of the second flow passage, where the outlet hub faces in a different direction from the inlet hub. In such embodiments, a flow path of the flow control module may extend from the inlet hub to the outlet hub, where the flow path includes the first flow passage and the second flow passage, and where the flow path may have three or less turns in direction between vertical and horizontal orientations. For example, as shown in FIG. 4, a flow path of a flow control module may include a flow passage extending from an inlet 112 in a horizontal orientation, a first turn in direction to a vertical orientation, where flow passage 124 extends vertically, and a second turn in direction to a horizontal orientation, where flow passage 136 extends horizontally to an outlet 119.

As shown in FIG. 7, some embodiments may include a flow control module having a turn in direction at a tie-in connector, where a flow passage extending in a vertical direction may have a turn in direction to one or more horizontally extending flow passages. Although more than one flow passage may extend horizontally from the tie-in connector, the tie-in connector may be considered as forming a single turn in direction from a vertical orientation to a horizontal orientation. For example, as shown in FIG. 7, main line 920 may extend in a vertical orientation, and a single turn in direction from vertical to horizontal flow may occur at a connector connecting the main line 920 to first branch line 922 and second branch line 924, where the first and second branch lines 922, 924 each extend in horizontal orientations.

In some embodiments, a flow meter may be positioned along a flow passage of a flow control module for top-down flow (where fluid may flow from an elevated position to a lower position), which may allow for a reduced number of turns in the flow path and a reduced number of components in the flow control module assembly (thereby reducing the weight and cost of the flow control module assembly), and which may improve the overall flow assurance (e.g., by providing less pressure drop and erosion rates). Flow control modules of the present disclosure may include multiphase flow meters, wet gas flow meters, single phase flow meters, or may include virtual metering.

According to embodiments of the present disclosure, a flow path through a flow control module may include two changes of direction. For example, as shown in FIG. 3, a flow path (indicated by arrows 101) may be formed through passageways in a flow control module 106, where the flow path includes two changes in direction, changing from a horizontal direction to a vertical direction and from a vertical direction to a horizontal direction. When flow control module 106 is connected to a tree 104, the flow path formed through the tree and connected flow control module assembly has three changes of direction, where the flow path may extend vertically through the tree vertical flow bore 103, change direction to extend horizontally through the connection between the tree 104 and the flow control module 106, change direction to extend vertically through flow passage 124 in the flow control module 106, and then change direction at the choke block 108 to extend horizontally through flow passage 136 in the flow control module 106 to the outlet 119. According to embodiments of the present disclosure, a flow path formed through a tree and connected flow control module assembly may include three changes of direction angled perpendicularly from each other (e.g., as shown in FIG. 3), or the changes in direction may be at a non-perpendicular angle from each other.

Further, a flow path may extend along a single plane through a tree and/or flow control module. For example, as shown in FIG. 3, a flow path extends along a single plane through the tree 104. In some embodiments, a flow path may extend along a single plane through a tree and connected flow control module assembly. In some embodiments, a flow path may extend along two intersecting planes through a tree and connected flow control module assembly. For example, as shown in FIG. 3, a flow path may extend along a first plane intersecting the vertical flow bore 103 and connector 110 of the tree 104 and connected flow control module 106 assembly, and the flow path may change directions to extend along a second plane intersecting the vertical passageway 124 and outlet 119 of the flow control module 106.

A flow path may be configured through a tree assembly (including a tree and a connected flow control module) such that flow loops in the flow path through the tree and/or flow control module may be eliminated, where flow loops may include paths directing flow in opposite directions. For example, a flow path may extend from an elevated position along a main vertical flow bore formed through a tree to an outwardly facing outlet in a connected flow control module at a lower position, where a choke and one or more instruments (e.g., a flow meter) may be positioned along the flow path. The outlet of the flow control module may be facing away from the connected tree, such that flow through the outlet of the flow control module is directed away from the connected tree. For example, if describing the flow path direction shown in FIG. 3 along an x-y-z-coordinate system, the flow path may extend in a z-direction along the vertical flow bore 103 of the tree 104, change directions to extend in an x-direction through the inlet of the flow control module 106, change directions to extend in an opposite z-direction from the flow path through the vertical flow bore 103, and change directions to extend in a y-direction through the outlet 119 of the flow control module 106. In such embodiment, the flow path does not extend in opposing directions through the flow control module 106, and thus a flow loop is not formed within the flow control module 106 (although the flow path does extend in opposite z-directions between the tree 104 and the flow control module 106). In some embodiments, a flow path may be "in-line" with a main vertical flow bore formed through a tree, such that changes in direction may occur along a single plane (e.g., along a plane intersecting a first and second direction in a three directional coordinate system).

A reduced flow path length through flow control modules according to embodiments of the present disclosure may be provided by limiting the number of changes in direction of the flow path (e.g., providing one or two changes in the flow path direction through a flow control module) and/or by providing an "in-line" flow path (where an in-line flow path extends along a single plane) through a flow control module. The reduced flow path length of flow control modules according to embodiments of the present disclosure may allow for lighter and more compact flow control modules.

Flow control modules according to embodiments of the present disclosure may be connected to trees having a configuration suited for the reduced flow path length through tree/flow control module assemblies disclosed herein. For example, a tree may have a connection hub positioned at an elevation corresponding to an inlet location on a flow control module according to embodiments of the present disclosure when the flow control module is mounted adjacent to the tree. A flow control module having a vertical inlet may be used with a tree having a vertical connection hub, and a flow control module having a horizontal inlet may be used with a tree having a horizontal hub. According to embodiments of the present disclosure, trees and flow control modules may be interchangeable with the correctly corresponding hub configurations.

Figure 9:
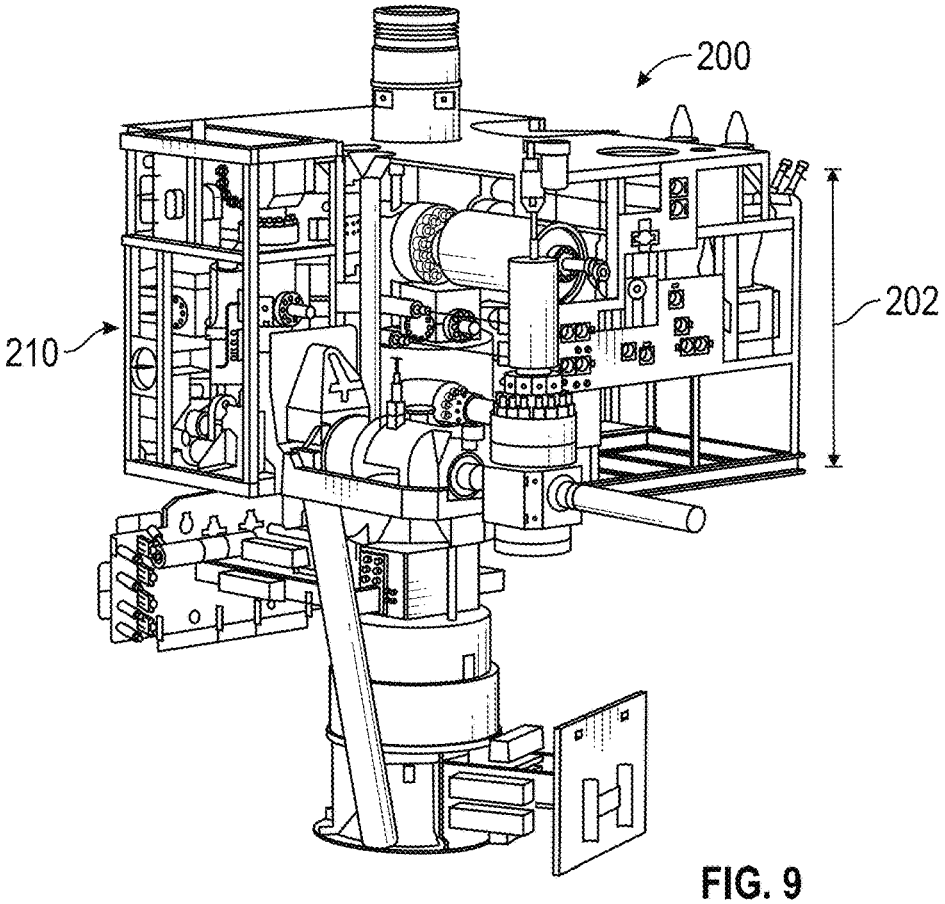
FIGS. 9-11 show two side views and a top view, respectively, of a tree assembly according to embodiments of the present disclosure.
Figure 10:
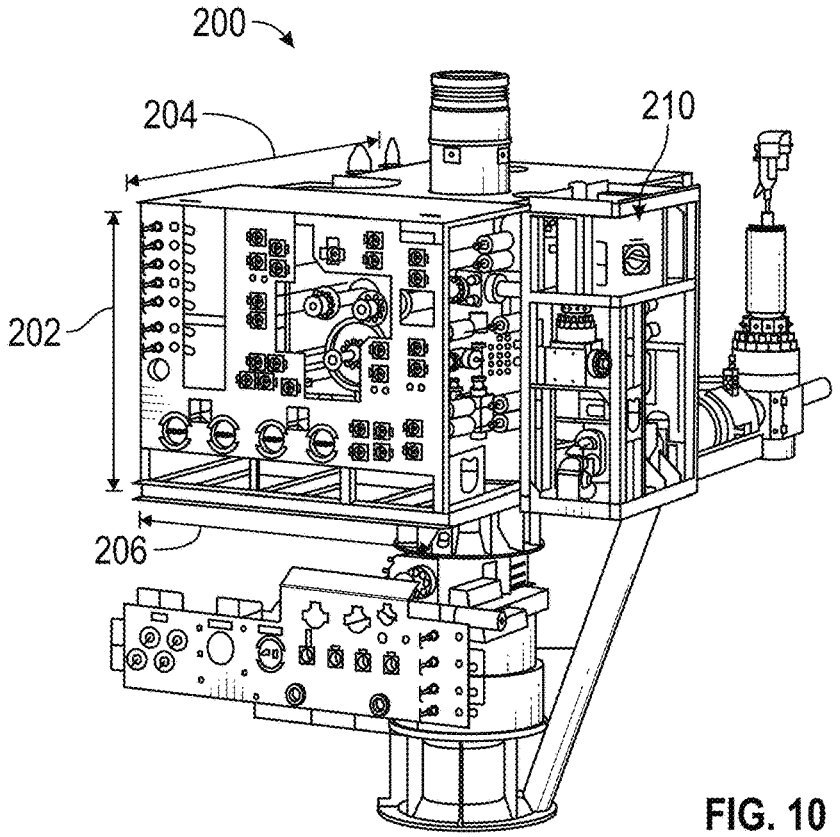
Figure 11:
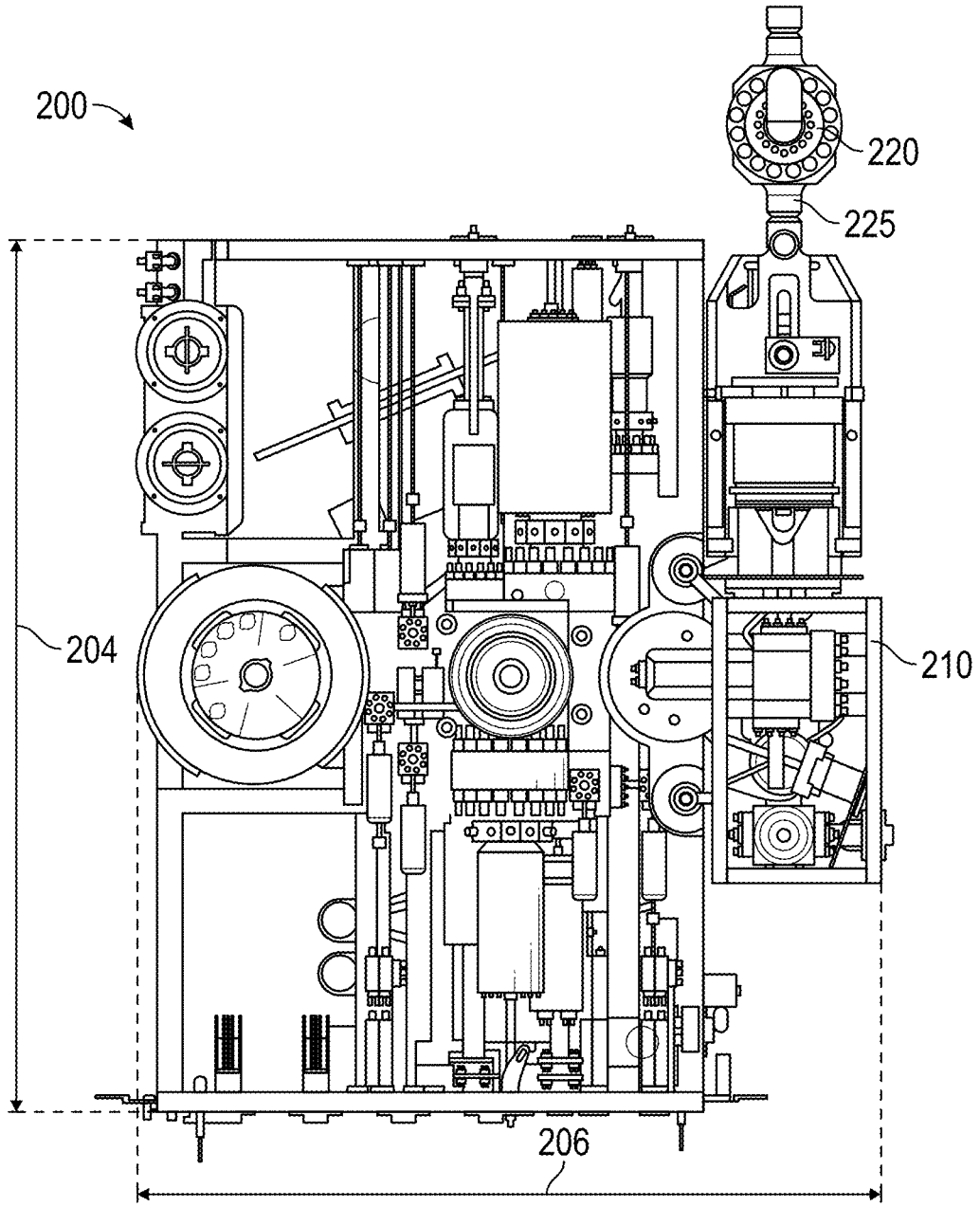

According to embodiments of the present disclosure, a tree may have a compact configuration including a reduced number of components and/or a reduced flow path length. Trees having compact configurations of the present disclosure may be lighter compared with conventionally configured trees, and may weigh, for example, from about 130,000 lbs to about 150,000 lbs. FIGS. 9-11 show side views and a top view, respectively, of an example of a tree 200 with a compact configuration. The tree 200 has a flow control module 210 according to embodiments of the present disclosure directly connected thereto. A production shut down valve 220, which may traditionally be used in a tree, may be disposed on a jumper 225 connected to the flow control module 210. The connected tree and flow control module assembly has a compact configuration having a height 202, a depth 204, and a width 206. The height 202 may be less than 17 ft, less than 16 ft, or less than 15 ft, for example, ranging between 14 and 16 ft. The depth 204 may be about 18.5 ft or less, for example, ranging between 16 and 18 ft. The width 206 may be about 15 ft or less, for example, ranging between 13 and 15 ft.

Compact tree configurations may be disposed around and suitable for use with a corresponding compact core assembly including a central valve block and tubing head, where a compact core assembly may further reduce the overall weight of the tree assembly. According to embodiments of the present disclosure, a compact core assembly may be provided by arranging the valves and flow lines extending from the central valve block in a relatively more in-line configuration, as described herein. For example, central valve blocks according to embodiments of the present disclosure may have a compact configuration including dedicated annulus and production flow lines extending relatively in-line and in opposite directions from the valve block central flow bore.

Figure 12:
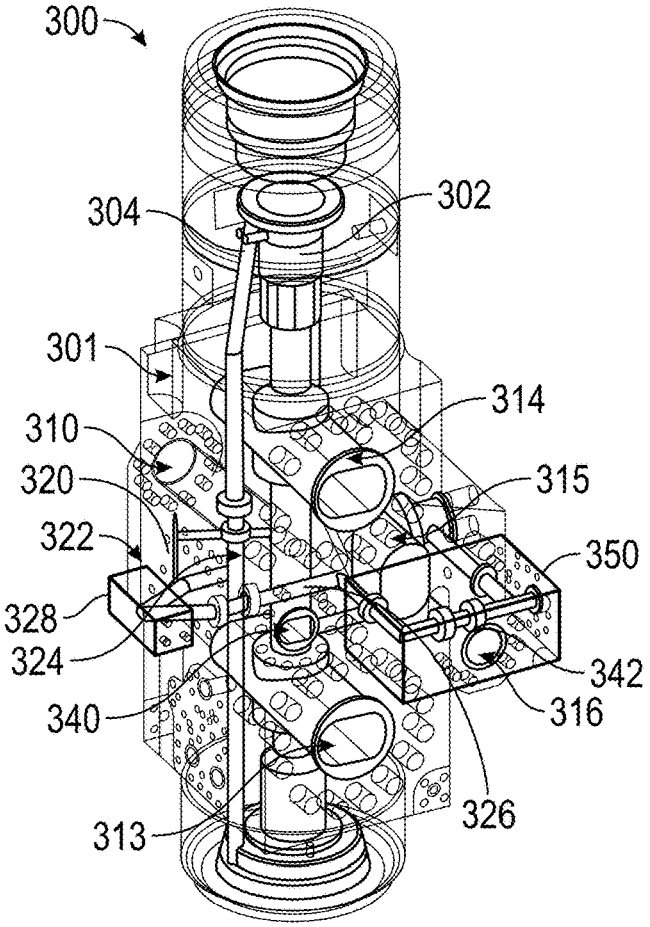
FIG. 12 shows a schematic view of a core assembly according to embodiments of the present disclosure.
Figure 13:
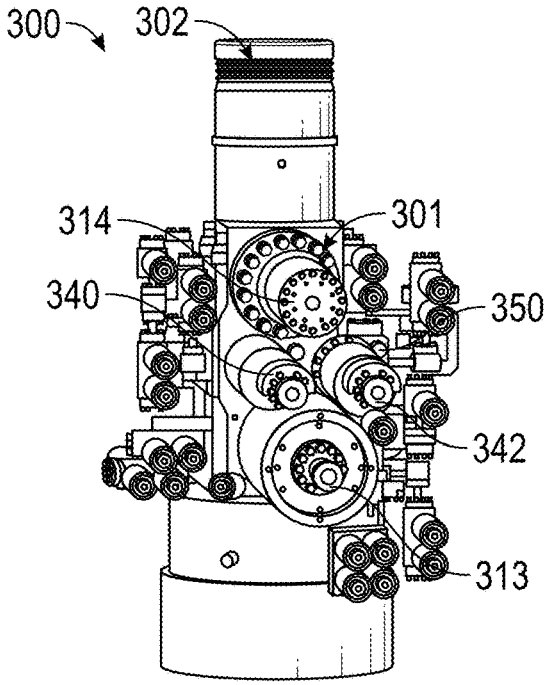
FIG. 13 shows a side view of the core assembly of FIG. 12.

FIGS. 12 and 13 show an internal schematic and a side view, respectively, of a compact core assembly 300 according to embodiments of the present disclosure. The compact core assembly 300 includes a production bore 302 and an annulus bore 304 extending through a single valve block 301 to the tubing head. The production bore 302 may comprise a production swab or safety valve 314 and a production master valve 313, with the safety valve 314 positioned closer to the top of the assembly 300 and the master valve 313 positioned closer to the tubing head when installed. A production wing branch 330 may extend from the production bore 302 between the valves 313 and 314 and comprise a production wing valve 332 (shown in FIG. 14).

The annulus bore 304 may comprise one or more bore segments in selective fluid communication through one or more valves. As depicted, the annulus bore 304 comprises an annulus safety or swab valve 310 and an annulus master valve 320. The annulus bore 304 may further comprise a wing branch 322 that extends from a segment 324 of the annulus bore 304 between valves 310 and 320, to an annulus wing valve 340. As depicted, the annulus wing valve 340 is positioned within a bore 326 that runs perpendicular to the annulus bore 304. In certain embodiments, a secondary block 328 may be attached to the tree to establish a flow path between the segment 324 and the wing valve 340 that forms, in part, the wing branch 322.

The assembly 300 further comprises a crossover flow path 316 between the annulus bore 304 and the production bore 302. As depicted, the crossover flow path 316 is in fluid communication at one end to annulus wing valve 340 and at the other end to the production wing branch 330. In certain embodiments, the crossover flow path may comprise at least one segment positioned within a removable, and interchangeable cross-over block 350. The cross-over block 350 may comprise, for instance, a crossover valve 342 that allows for the crossover flow path 316 to be selectively opened and closed as needed. In certain embodiments, the crossover valve 342 may be excluded, with the annulus wing valve 330 controlling the crossover function.

In the embodiment shown, the actuators associated with the various valves of the assembly 300 are positioned on different sides of the assembly, which functions to reduce the overall width of the assembly compared to assemblies in which all or more valve/actuators are positioned on one side. As depicted, the production swab valve 314, production master valve 313, annulus wing valve 340, and crossover valve 342 are positioned on a first side of the tree, while the annulus swab valve 310, annulus master valve 320 and production wing valve 332 may extend from a second side of the assembly 300 opposite the first side. In some embodiments, a subsea tree may include a plurality of actuators associated with a plurality of valves in the subsea tree, where at least one of the plurality of actuators is disposed on a first side of the subsea tree and at least another of the plurality of actuators is disposed on an opposite side of the subsea tree. It should be appreciated that the particular arrangement of the valves/actuators are not limited to the embodiment shown.

Figure 14:
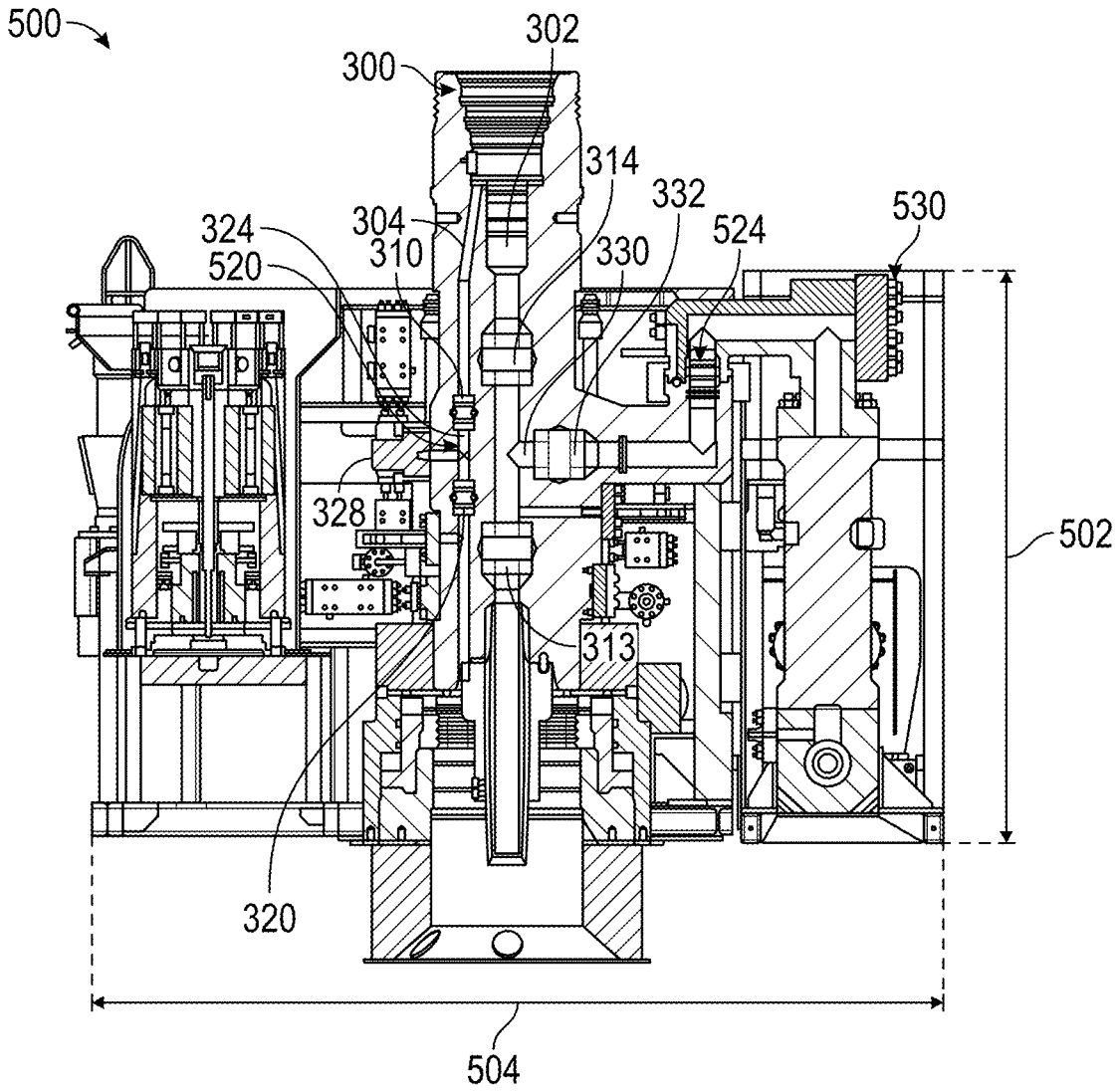
FIG. 14 shows a cross sectional view of a tree assembly according to embodiments of the present disclosure.

Referring now to FIG. 14, FIG. 14 shows a cross sectional view of a tree assembly having a compact tree 500 assembled to a compact core assembly 300, as described above, and a flow control module 530 attached to the tree 500. The compact core assembly 300 is in an in-line configuration with the tree 500. When describing the in-line configuration of the compact tree and core assembly in a three-directional coordinate system, the height 502 extends along a z-direction of the coordinate system, the depth 504 extends along an x-direction of the coordinate system, and the width extends along a y-direction of the coordinate system. Annulus and production flow lines 520 may extend in opposite directions along the x-direction from the core assembly 300. One of the annulus and production flow lines 520 includes a production flow line having a production wing valve 322 and extending to a connection 524 to a flow control module 530.

In the embodiment shown in FIG. 14, a vertical connection 524 is provided between the tree 500 and the flow control module 530 (in contrast to the horizontal connection provided between a tree and flow control module described with FIGS. 1-5). According to some embodiments, a tree configured for vertical connection, such as shown in FIG. 14, may be modified to work with a horizontal connector of a flow control module (such as shown in FIGS. 1-5), for example, by providing an adaptor to connect to a vertical connection at one end and a horizontal connection at an opposite end. Accordingly, trees, flow control modules and module connector types of the present disclosure may be interchangeable, such that different tree configurations of the present disclosure may be used in combination with different flow control module configurations of the present disclosure.

Figure 16:
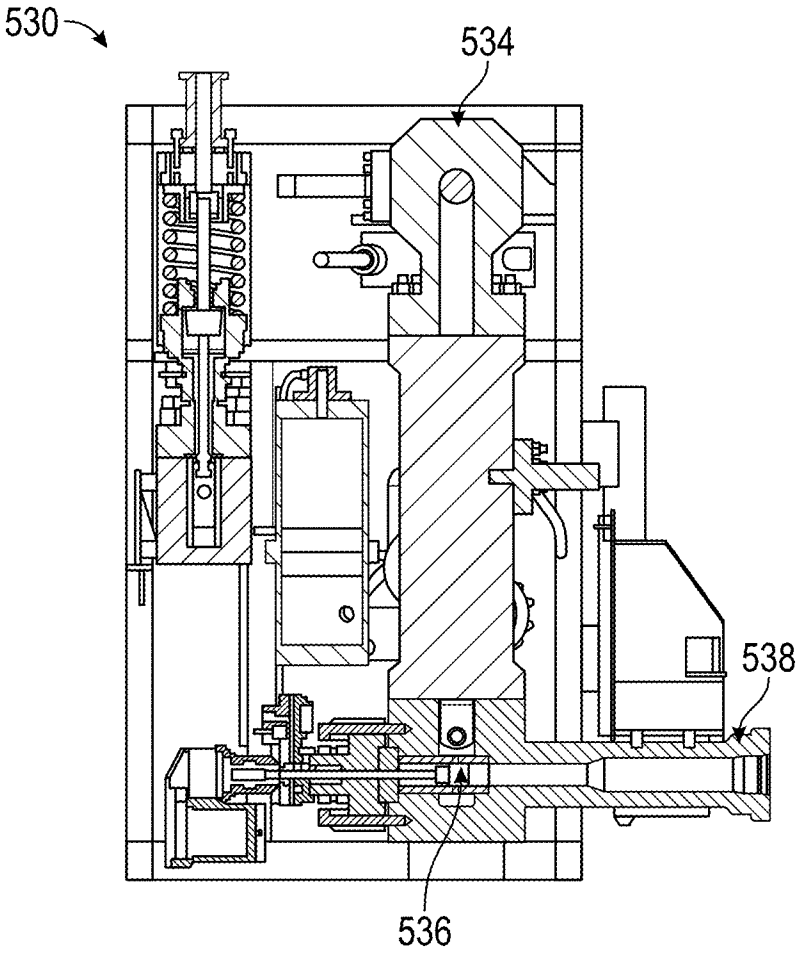
FIGS. 15 and 16 show a side view and a cross sectional view, respectively, of a flow control module according to embodiments of the present disclosure.
Figure 15:
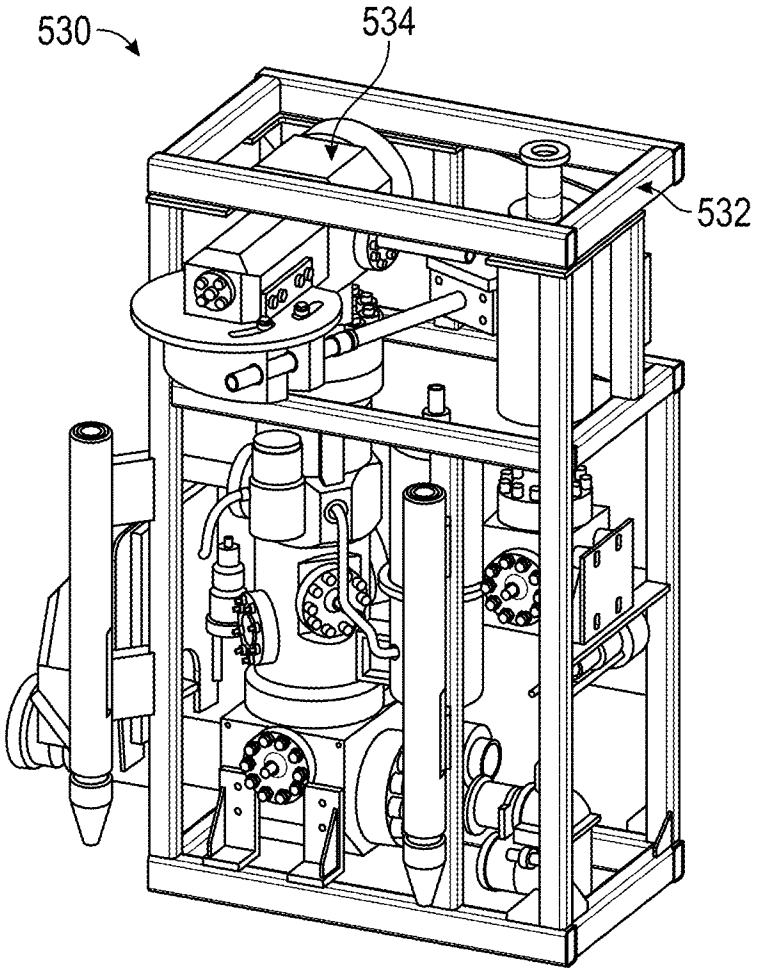

FIGS. 15 and 16 show additional views of the compact flow control module 530 shown in FIG. 14. The flow control module 530 includes a frame 532, which generally contains the components and pipework of the flow control module 530. A connection hub 534 at an inlet to the flow control module 530 may connect to a flow line of an adjacent tree assembly. A vertical flow passage extends from the connection hub 534 to a choke 536, and a horizontal flow passage extends from the choke 536 to an outlet 538 of the flow control module. In the embodiment shown, a shut down valve may be provided on an attached jumper rather than within the flow control module.

In contrast to the in-line configuration of annulus and production flow lines of the core assembly 300 shown in FIGS. 12 and 13, conventional core assemblies may have annulus and production flow lines extending in a side-by-side configuration. For example, a conventional core assembly may include a main bore extending to the tubing head and a plurality of flow lines extending outwardly therefrom. The flow lines of a conventional core assembly may include production and annulus flow lines extending in the same direction in a side-by-side configuration. Extension valve blocks extending outwardly from a main valve block provide additional area allowing the annulus and production flow lines to extend in the same direction in the side-by-side configuration of the conventional core assembly. The extension valve blocks may be attached to the main valve block, for example, using bolts and/or welds. The annulus and production flow lines of a conventional core assembly may include an annulus flow line having an annulus safety valve, an annulus flow line having an annulus wing valve, an annulus flow line having an annulus master valve, a production flow line having a production master valve, a production flow line having a production safety valve, a production flow line having a production wing valve, and a crossover line having a crossover valve.

The compact core assembly 300 shown in FIGS. 12 and 13 may have a more compact configuration than a conventional core assembly, such as described above, by arranging annulus and production bores in-line with a central or main flow bore of the compact core assembly extending in opposite directions, while a conventional core assembly may have flow lines arranged off extension blocks from a main valve block to extend in the same direction.

A compact tree assembly in accordance with the present disclosure may be configured to continue an in-line annulus and production flow line configuration of a compact core assembly, for example, by extending flow lines in the in-line configuration. For example, referring again to FIG. 11, a compact tree configuration includes a plurality of annulus and production flow lines extending in opposite directions to provide an in-line flow line configuration.

Figure 17:
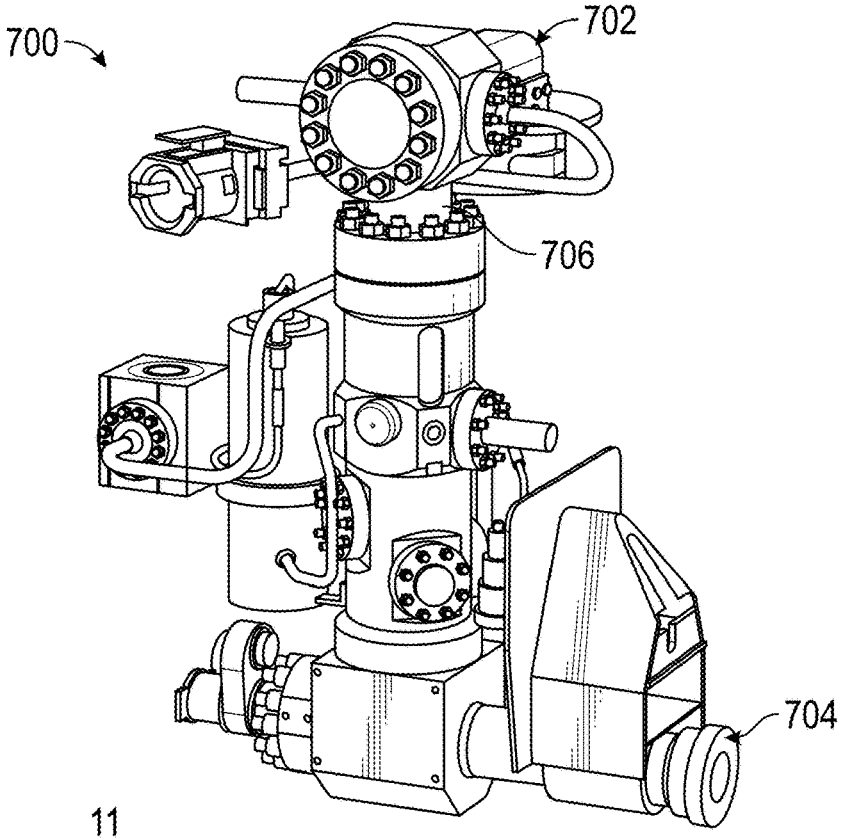
FIG. 17 shows a side view of a flow control module according to embodiments of the present disclosure.

A compact configuration of a flow control module may be provided by removal of additional conduits and closure welds from the flow control module. For example, FIG. 17 shows an example of a compact flow control module 700 according to embodiments of the present disclosure. The compact flow control module 700 includes a primary flow path extending through components directly attached together between the inlet 702 and the outlet 704 of the flow control module 700, without the use of additional connecting conduits and closure welds. A plurality of bolted connections may be used to assemble the flow path between a main valve block of a tree and an outlet of the tree assembly (which may be attached to a jumper, for example). For example, as shown in FIG. 17, a plurality of bolts 706 are used to connect the inlet flow path portion of the flow control module to a vertical flow path portion of the flow control module 700. In contrast, a conventional flow control module may include a plurality of conduits connected through closure welds exposed to a primary flow path between inlet and outlet connections. For example, a conventional flow control module may provide a plurality of welded joints between the main valve block of a tree and a jumper connected to the tree assembly.

Figure 18:
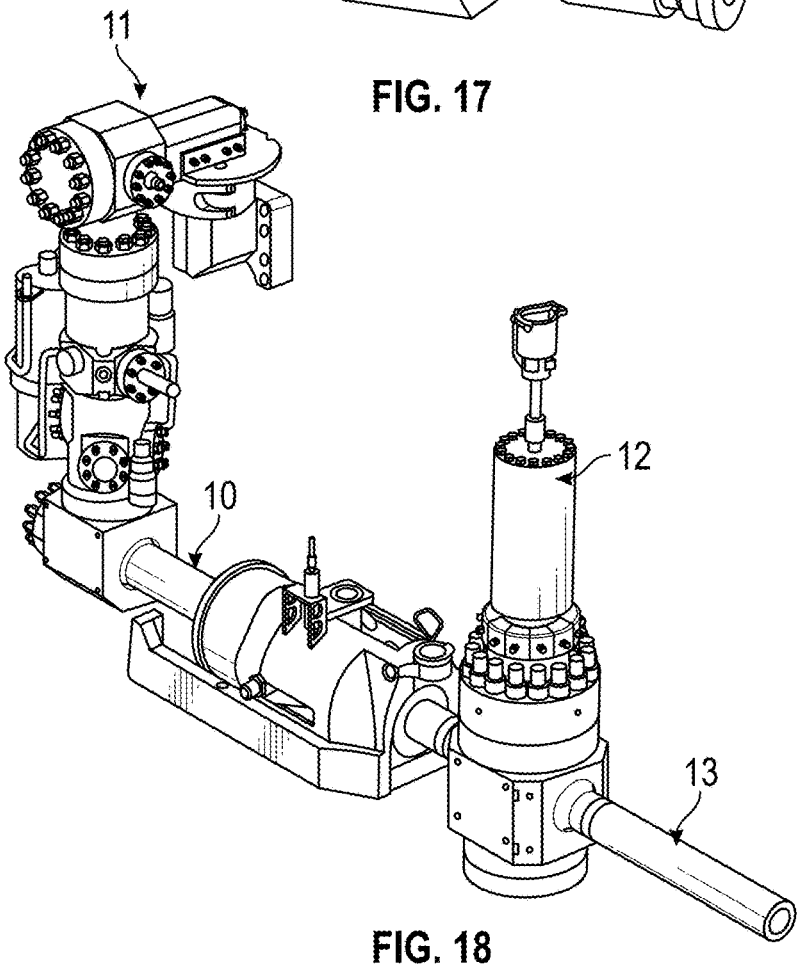
FIG. 18 shows a production shutdown valve disposed along a jumper according to embodiments of the present disclosure.

According to some embodiments of the present disclosure, a production shutdown valve may be moved from a tree assembly and disposed along a jumper connected to a flow control module. For example, FIG. 18 shows a flow path 10 through a flow control module 11 and connected jumper 13 having a production shutdown valve 12 disposed along the flow path in the jumper 13. By moving the production shutdown valve to the jumper, flow loops in the flow path of a tree assembly may be reduced or eliminated. Further, by moving the production shutdown valve to the jumper, the tree and/or flow control module may be retrieved without evacuating the jumper of hydrocarbons.

Figure 19:
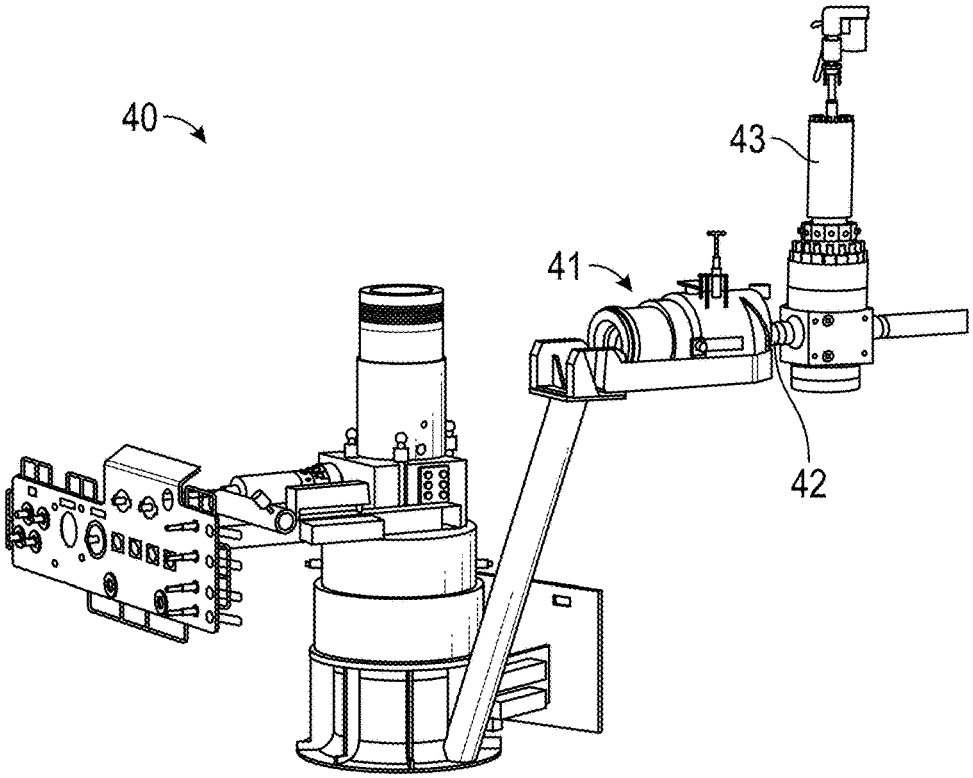
FIG. 19 shows a horizontal connection between a flow control module and a jumper according to embodiments of the present disclosure.

Connections between a flow control module and a jumper may be horizontally oriented or vertically oriented. For example, FIG. 19 shows a partial tree and flow control module assembly 40 having a horizontal jumper connection between the flow control module 41 and a jumper 42. By arranging the tree and flow control module in a compact in-line configuration, such as described herein, the outlet of the flow control module 41 may be oriented in a horizontal, outwardly facing direction from the flow control module and at an elevated position from the base of the tree assembly. Further, the embodiment shown in FIG. 19 has a production shutdown valve 43 disposed on the jumper 42. In some embodiments, a tree assembly may include a vertical jumper connection between the flow control module and a jumper.

According to embodiments of the present disclosure, a hydraulic connection system may be used when connecting a jumper to an outlet of a flow control module. The hydraulic connection system may include a pull-in tool where one end of the pull-in tool may be attached to a connection hub of the flow control module, and an opposite end of the pull-in tool may be attached to an attachment portion of the jumper. When the ends of the pull-in tool are attached to the flow control module connection hub and the jumper, the pull-in tool may be hydraulically activated to pull the ends towards each other, thereby pulling the connection hub and jumper toward each other.

Figure 20:
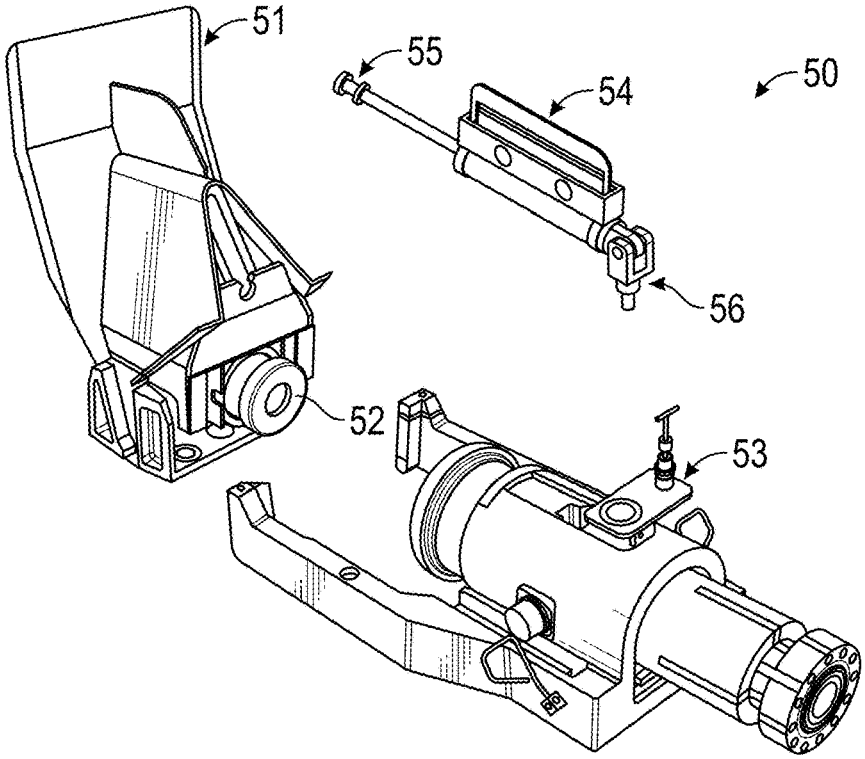
FIG. 20 shows a hydraulic connection system according to embodiments of the present disclosure.

FIG. 20 shows an example of a hydraulic connection system 50 according to embodiments of the present disclosure. The hydraulic connection system includes a connection hub 51 at an outlet 52 of a flow control module (not shown), an attachment portion of a jumper 53, and a pull-in tool 54. A first end 55 of the pull-in tool 54 may be attached to the connection hub 51 and a second end 56 of the pull-in tool 54 may be attached to the attachment portion of the jumper 53. Once the first and second ends 55, 56 are attached to their respective components, the pull-in tool 54 may hydraulically pull together the connection hub 51 and the jumper 53.

Figure 21:
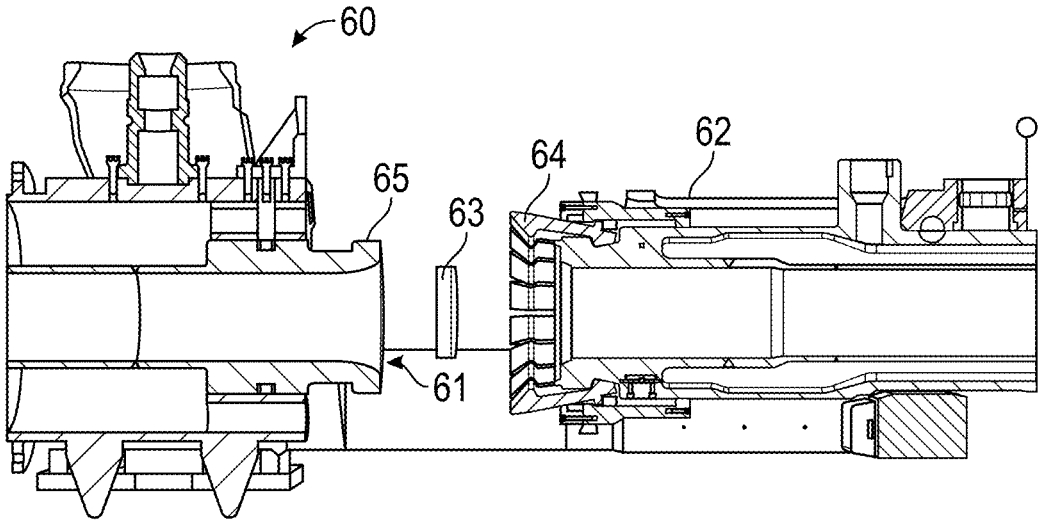
FIGS. 21 and 22 show a connection between an outlet of a flow control module and a jumper according to embodiments of the present disclosure.
Figure 22:
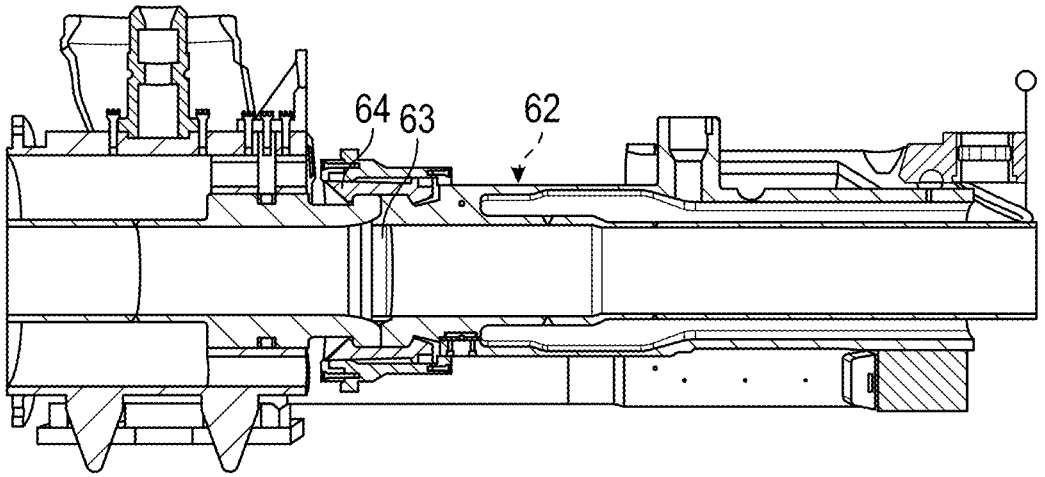

FIGS. 21 and 22 show cross sectional views of an outlet of a flow control module being connected to an attachment portion of a jumper. Particularly, an outlet 61 of a flow control module 60 may be aligned with an attachment end of a jumper 62. A sealing element 63 may be disposed between the outlet 61 and attachment end of the jumper 62. The attachment end of the jumper 62 may include a plurality of collets 64 extending outwardly from the attachment end of the jumper 62 around the circumference of the attachment end. When the attachment end of the jumper 62 is pulled toward the outlet 61, such that the collets 64 contact the outlet 61, the collets 64 may be forced outwardly around the outer perimeter of the outlet 61 and over a lip 65 formed around the outer perimeter of the outlet 61. When the heads of the collets 64 move over the lip 65 formed around the outer perimeter of the outlet 61, the lip 65 may retain the collets from retracting, thereby connecting the attachment end of the jumper 62 to the outlet 61. FIG. 22 shows the connected outlet 61 and attachment end of the jumper 62 with the sealing element 63 retained there between.

According to embodiments of the present disclosure, a method for using a flow control module may include connecting an inlet hub of the flow control module to a flow passage of a subsea tree, connecting an outlet hub of the flow control module to a flowline directed away from the subsea tree, directing fluid from the flow passage of the subsea tree through the inlet hub of the flow control module, directing the fluid through at least one flow passage located in the flow control module to the outlet hub, and directing the fluid from the outlet hub to the connected flowline. Connecting an outlet hub of the flow control module to a flowline directed away from the subsea tree may include attaching a first end of a pull-in tool to the outlet hub, attaching a second end of the pull-in tool to an attachment end of the flowline, and pulling the outlet hub and the attachment end toward each other using the pull-in tool. In some embodiments, a connection made between a flow passage of a subsea tree or subsea equipment and an inlet hub of a flow control module may be horizontal or vertical.

In some embodiments, at least one flow passage in a first flow control module includes a main line and at least one branch line, where a main line of a second flow control module may be connected to at least one branch line of a first flow control module, and where fluid may be flowed from the first flow control module through the main line of the second flow control module.

Systems according to embodiments of the present disclosure may include a first flow control module directly or indirectly connected to first equipment device (e.g., a subsea tree or other subsea equipment unit), where a fluid may flow from the first equipment device, through the connected first flow control module, and out an outlet in the first flow control module. In some embodiments, a subsea system may include a first flow control module that includes an inlet and at least one outlet, a main line that is in fluid communication with the inlet, a first branch line coupled to the main line and to a first outlet of the at least one outlet, a first equipment device connected to the inlet, and a second equipment device connected to the first outlet.

In some embodiments, the first flow control module may further have a second branch line coupled to the main line and to a second outlet of the at least one outlet and a tie-in connector coupled to the inlet of the first flow control module, wherein the first equipment device is coupled to the tie-in connector. The first equipment device may be, for example, a manifold, a subsea tree or a subsea structure.

In some embodiments, the second equipment device may be a second flow control module having a second inlet connected to the first outlet, such that the second flow control module is coupled in series to the first flow control module. In some embodiments, the second equipment device may be a jumper.

In some embodiments, a first equipment device connected to a flow control module inlet may be a subsea tree having a tree frame and a plurality of annulus and production lines extending in an in-line configuration from a core assembly, wherein the plurality of annulus and production lines extend in opposite directions from each other around the core assembly. The core assembly may include a main flow bore extending through a single valve block to a tubing head, the valve block being an integrally formed piece, where the annulus and production lines may extend from the valve block. The first flow control module may be attached to an outer side of the tree frame. A second equipment device may be a jumper flowline directed away from subsea tree.

By providing an outlet of a tree assembly through a flow control module portion of the tree assembly, the length of a flow path through the tree assembly may be reduced, thereby allowing the weight of the tree assembly to be reduced.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A subsea tree, comprising:

a compact core assembly, comprising:

a body having a central valve block;

a production bore and an annulus bore extending axially through the body to a tubing head;

a production wing branch extending from the production bore and positioned between a production safety valve and a production master valve, wherein a production wing valve is provided along the production wing branch;

an annulus wing branch extending from the annulus bore and positioned axially between an annulus safety valve and an annulus master valve, wherein the annulus wing branch comprises:

an annulus wing bore extending in a direction perpendicular to the annulus bore; and an annulus wing valve provided along the annulus wing bore;

wherein the production safety valve, the production master valve, and the annulus wing valve are positioned on a first side of the compact core; and wherein the annulus safety valve, annulus master valve, and production wing valve are positioned on a second side, opposite the first side, of the compact core.

2. The subsea tree of claim 1, further comprising a plurality of valve actuators, each of the plurality of valve actuators associated with each of the production safety valve, the production master valve, the annulus wing valve, the annulus safety valve, the annulus master valve, and the production wing valve, and wherein the plurality of valve actuators is provided along the first side and the second side of the compact core.

3. The subsea tree of claim 1, further comprising a crossover flow path fluidly connected between the annulus wing valve and the production wing branch.

4. The subsea tree of claim 3, wherein at least a portion of the crossover flow path is formed through a removable crossover block, and wherein a crossover valve is provided along the crossover flow path on the removable crossover block.

5. The subsea tree of claim 1, further comprising a tree frame surrounding the body of the subsea tree.

6. The subsea tree of claim 1, wherein the subsea tree weighs between 130,000 and 150,000 pounds.

7. The subsea tree of claim 1, further comprising a flow control module connected to the subsea tree to provide a tree and flow control module assembly, wherein the tree and flow control module comprises:

a height less than 17 feet;

a depth less than or equal to 18.5 feet; and a width less than or equal to 15 feet.

8. A system, comprising:

a compact tree, comprising:

a body having a central valve block;

a production bore and an annulus bore extending axially through the body to a tubing head;

a production wing branch extending from the production bore and positioned between a production safety valve and a production master valve, wherein a production wing valve is provided along the production wing branch;

an annulus wing branch extending from the annulus bore and positioned axially between an annulus safety valve and an annulus master valve, wherein the annulus wing branch comprises:

an annulus wing bore extending in a direction perpendicular to the annulus bore; and an annulus wing valve provided along the annulus wing bore;

wherein the production safety valve, the production master valve, and the annulus wing valve are positioned on a first side of the compact tree; and wherein the annulus safety valve, annulus master valve, and production wing valve are positioned on a second side, opposite the first side, of the compact tree;

a tree frame surrounding the compact tree;

a flow control module mounted to a first side of the tree frame, fluidly connected to a production lines extending in a first direction from the first side of the valve block; and a jumper connected to the flow control module, wherein a production shut down valve is provided along the jumper, and wherein the jumper is configured in a non-horizontal orientation.

9. The system of claim 8, further comprising a blow out preventer coupled to a top hub of the compact tree.

* * * * *